US005709382A

United States Patent [19]

Shima

[11] Patent Number: 5,709,382

[45] Date of Patent: Jan. 20, 1998

[54] SHEET DISCHARGING DEVICE FOR A PRINTER

[75] Inventor: Masayuki Shima, Sendai, Japan

[73] Assignee: Tohoku Ricoh Co., Ltd., Miyagi-ken, Japan

[21] Appl. No.: 618,104

[22] Filed: Mar. 19, 1996

[30] Foreign Application Priority Data

May 15, 1995 [JP] Japan ..... 7-116080

[51] Int. Cl.[6] ..... B65H 31/00

[52] U.S. Cl. ..... 271/209; 271/213; 271/223

[58] Field of Search ..... 271/209, 213, 271/223, 171, 161

[56] References Cited

U.S. PATENT DOCUMENTS

| | | | |
|---|---|---|---|
| 1,891,286 | 12/1932 | Miersch . | |
| 2,570,994 | 10/1951 | Vaughan et al. | 271/223 |
| 3,160,413 | 12/1964 | Faeber | 271/209 |
| 4,313,669 | 2/1982 | Larson et al. | 271/209 |
| 4,607,834 | 8/1986 | Dastin | 271/223 |
| 4,660,819 | 4/1987 | Allocco et al. | 271/223 |
| 4,667,949 | 5/1987 | Goodwin et al. | 271/209 |
| 5,029,841 | 7/1991 | Ettischer et al. | 271/223 |
| 5,419,548 | 5/1995 | Ueda et al. | 271/209 |
| 5,451,044 | 9/1995 | Nakayama | 271/209 |

FOREIGN PATENT DOCUMENTS

| | | | |
|---|---|---|---|
| 0 571 195 | 11/1993 | European Pat. Off. . | |
| 1125951 | 5/1962 | Germany | 271/223 |
| 1 202 289 | 10/1965 | Germany . | |
| 41-16675 | 8/1941 | Japan . | |
| 43-19929 | 8/1943 | Japan . | |
| 61-57260 | 12/1986 | Japan . | |
| 5-10367 | 2/1993 | Japan . | |
| 405310329 | 11/1993 | Japan | 271/161 |
| 5-89355 | 12/1993 | Japan . | |
| 5-89356 | 12/1993 | Japan . | |
| 6-171819 | 6/1994 | Japan . | |
| 6-329327 | 11/1994 | Japan . | |
| 2 017 622 | 10/1979 | United Kingdom . | |

*Primary Examiner*—H. Grant Skaggs

*Attorney, Agent, or Firm*—Oblon, Spivak, McClelland, Maier & Neustadt, P.C.

[57] ABSTRACT

In an image forming apparatus, a sheet stacking device for stacking sheets sequentially driven out of the apparatus body has a stack tray including a base, and a pair of side fences mounted on the base and each having an inclined portion. The side fences are moved to positions matching the width of sheets beforehand. When the sheet driven out of the apparatus body falls onto the base, the opposite widthwise edges of the sheet are reshaped in an inverted arch configuration by the inclined portions of the side fences. Hence, sheets sequentially stacked on the base have their opposite edges accurately aligned with each other.

14 Claims, 16 Drawing Sheets

SHEET DISCHARGING DEVICE FOR A PRINTER

BACKGROUND OF THE INVENTION

The present invention relates to an image forming apparatus for transferring images representative of a document image to sheets and discharging the sheets and, more particularly, to a device for discharging the sheets carrying the images thereon.

Image forming apparatuses include electrophotographic copiers, laser printers, and stencil printers, offset printers and other printers. Among the printers, the stencil printer is extensively used because it is capable of producing a great number of printings rapidly at low cost. In the stencil printer, a stencil is cut, or perforated, to form an image corresponding to a document image. The perforated stencil or master is wrapped around a drum Which permeates ink therethrough. An ink supply mechanism is disposed in the drum and feeds ink to the master via the drum. When a sheet is pressed against the master, the ink is transferred from the drum to the sheet via the perforations of the stencil. The stencil printer saves cost because it can produce a great amount of printings continuously at high speed with a single master.

It has been customary with the stencil printer or similar printer to stack sheets, or printings, sequentially driven out of the printer body on a stack tray or similar sheet discharging device. The problem with the conventional sheet discharging device is that the behavior of the sheet falling toward the stacking position of the device is unstable due to its configuration. As a result, the edges of the sheets sequentially reached the stacking position are deviated from each other, or a substantial period of time is necessary for each sheet to move to and stop at the expected stacking position. This stems from the fact that the image surface of the sheet lengthens because the quantity of water absorption differs from the image surface to the non-image surface of the sheet. Consequently, the sheet is bent in an arch configuration in which the intermediate portion in the widthwise direction of the sheet is convex upward. When the bent sheet is dropped toward a preselected position on a stack tray, it is apt to draw air into the rear thereof opposite to the image surface. The resulting turbulence increases the air resistance of the sheet and thereby obstructs the smooth fall of the sheet, i.e., renders the behavior of the sheet failing toward the stack tray unstable. This often effects the orientation of the edges of the sheet and increases the period of time necessary for the sheet to reach the stack tray.

In any case, the time-consuming sheet discharge effects the printing speed available with the stencil printer in a continuous print mode and obstructs high-speed printing. The misaligned edges of the sheets must be aligned by preprocessing in a duplex print mode, multiplex print mode or similar print mode, deteriorating the overall printing efficienty. Further, when the image surface of the sheet stacked on the tray is not sufficiently dry, the following sheet whose behavior is unstable, as stated above, rubs the underlying sheet. This brings about a defective image and the transfer of the ink from the underlying sheet to the rear of the overlying sheet.

To reshape the sheet having the arch configuration, there have been proposed various implementations which provide the sheet with an inverted arch configuration, as follows.

(1) Japanese Patent Laid-Open Publication No. 6-171819 (referred to as Prior Art 1 hereinafter) teaches a tray having a base and side fences or auxiliary side fences positioned inward of the side fences. The fences are resiliently supported by the base such that their upper portions are tiltable toward each other in order to regulate the behavior of the opposite widthwise edges of the sheet.

(2) Japanese Utility Model Laid-Open Publication No. 5-89355 (referred to as Prior Art 2 hereinafter) discloses a tray having a stop member for stopping the leading edge of the sheet, and side fences. The stop member and side fences are each formed with an opening in order to release air which obstructs the fall of the sheet.

(3) Japanese Utility Mode Laid-Open Publication No. 5-89356 (referred to as Prior Art 3 hereinafter) proposes a tray having a base and guide members each having an inclined surface. The guide members are located at the inlet side of the base with respect to the direction of sheet discharge so as to face the opposite edges of the sheet, thereby providing the sheet with the inverted arch deformation.

(4) Japanese Patent Publication No. 61-57260 (referred to as Prior Art 4 hereinafter) teaches guide members for causing the opposite edges of the sheet to bend during the course of transport.

(5) Japanese Patent Laid-Open Publication No. 6-329327 (referred to as Prior Art 5 hereinafter) discloses side fences having movable members capable of abutting against and bending the opposite edges of the sheet. The sheet is provided with the inverted arch configuration when its edges abut against the movable members during the course of fall.

However, the conventional schemes described above are not fully satisfactory, as will be discussed specifically later. It is to be noted that Japanese Utility Model Publication No. 41-16675, Japanese Utility Model Publication No. 43-19929, Japanese Utility Model Laid-Open Publication No. 5-10367 and German AUSLEGESCHRIFT 1,202,289 teach technologies relevant to the present invention.

SUMMARY OF THE INVENTION

It is an object of the present invention to provide a sheet discharging device for a printer and capable of aligning the opposite widthwise edges of sheets at a stacking position thereof without regard to the sheet size.

It is another object of the present invention to provide a sheet discharging device for a printer and capable of surely aligning the opposite widthwise edges of sheets even when the number sheets increases.

It is still another object of the present invention to provide a sheet discharging device for a printer and protecting sheets at a stacking position thereof from deformation and damage.

It is yet another object of the present invention to provide a sheet discharging device for a printer and facilitating the removal of a sheet stack from a stacking position thereof.

It is a further object of the present invention to provide a sheet discharging device for a printer and having a base which can be efficiently put away in a compact configuration.

In accordance with the present invention, a sheet stacking device having a base for stacking sheets driven out of an image forming apparatus has a pair of side fences mounted on the base and facing each other. Each side fence is movable in the widthwise direction of the sheets perpendicular to the intended direction of sheet discharge. Each side fence has a guide surface parallel to the intended direction of sheet discharge at its position facing one edge of the sheet in the widthwise direction. An end plate is mounted on the front portion of the base in the intended direction of sheet discharge, and has a surface for stopping the leading edge of the sheet in the intended direction of sheet discharge. The side fences each has an inclined portion in the lower portion of the guide surface facing one edge of the sheet. The inclined portion protrudes toward the center in the widthwise direction of the sheets from the upper portion to the lower portion of the side fence, and has an angle for causing the edge of the sheet to warp upward.

Also, in accordance with the present invention, a sheet stacking device having a base for stacking sheets driven out of an image forming apparatus has a pair of side fences mounted on the base and facing each other. Each side fence is movable in the widthwise direction of the sheets perpendicular to the intended direction of sheet discharge. Each side fence is foldable toward and away from the stacking surface of the base. Each side fence has a guide surface parallel to the intended direction of sheet discharge at its position facing one of opposite edges of the sheet in the widthwise direction. An end plate is mounted on the front portion of the base in the intended direction of sheet discharge, and has a surface for stopping the leading edge of the sheet in the intended direction of sheet discharge. A pair of reshaping means are respectively independent of the pair of side fences. Each reshaping means has an inclined surface or an inclined ridge line in the lower portion of its guide surface which faces the edge of the sheet. The inclined surface or the inclined ridge line protrudes toward the center in the widthwise direction of the sheets from the upper portion to the lower portion of the reshaping means, and has an angle for causing the edge of the sheet to warp upward. The inclined surface or the inclined ridge line is retractable outward away from the guide surface of the side fence.

Also, in accordance with the present invention, a sheet stacking device having a base for stacking sheets driven out of an image forming apparatus has a pair of side fences mounted on the base and facing each other. Each side fence is movable in the widthwise direction of the sheets perpendicular to the intended direction of sheet discharge. Each side fence has a guide surface parallel to the intended direction of sheet discharge at its position facing one edge of the sheet in the widthwise direction. An end plate is mounted on the front portion of the base in the intended direction of sheet discharge, and has a surface for stopping the leading edge of the sheet in the intended direction of sheet discharge. The side fences each has an inclined portion in the lower portion of the guide surface facing one edge of the sheet. The inclined portion protrudes toward the center in the widthwise direction of the sheets from the upper portion to the lower portion of the side fence, and has an angle for causing the edge of the sheet to warp upward. The inclined portion has a continuous inclined surface which is extended beyond a range of the side fence in the intended direction of sheet discharge.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, problems with the prior art paper discharging devices will be described.

Figure 1:
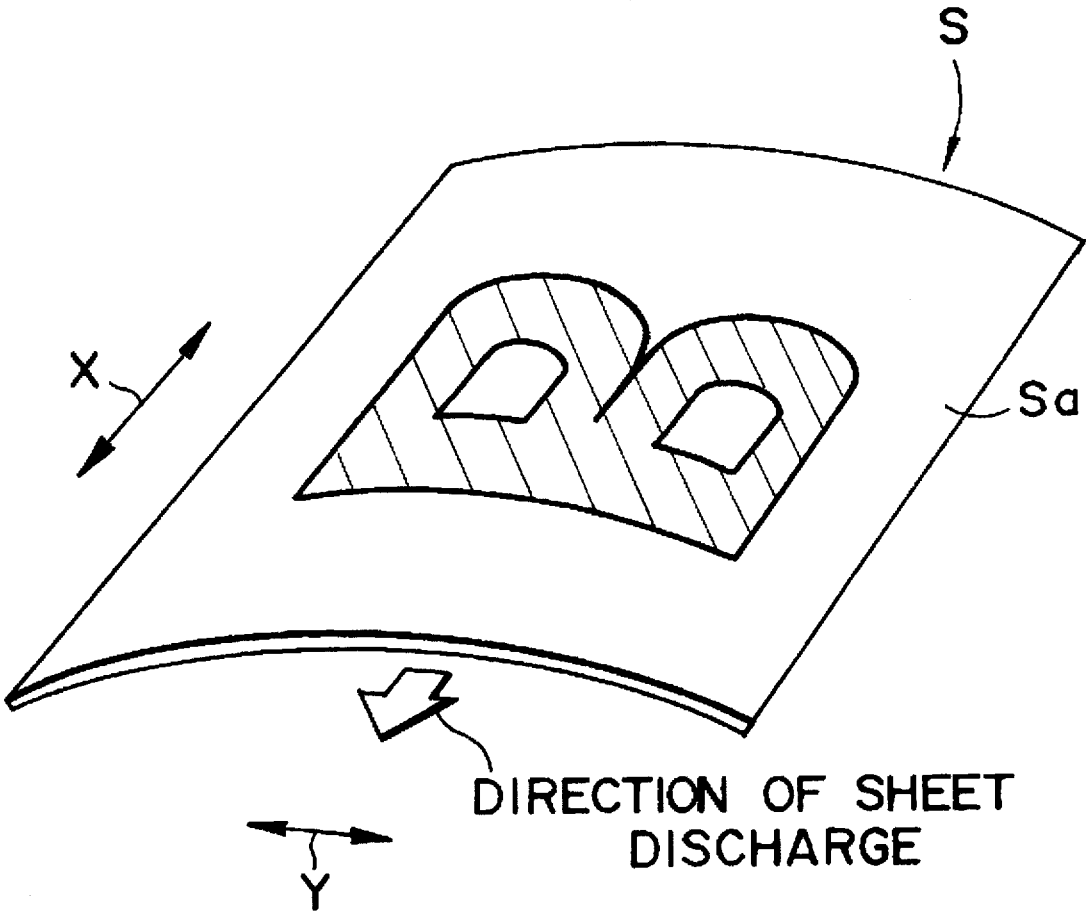
FIG. 1 PRIOR ART
FIG. 1 is an external perspective view showing the deformation of a sheet driven out of a printer.

FIG. 1 shows a sheet S carrying an image printed by, e.g., a stencil printer thereon and driven out of the printer. As shown, the sheet S is usually conveyed in a lengthwise direction X in which fibers constituting the sheet S extend. This kind of conveyance is feasible for high-speed continuous printing because the sheet S has high bending rigidity in the direction of conveyance, as generally accepted in the printers art. However, the fibers forming the image surface Sa of the sheet S and containing water swell and lengthen, causing the entire surface Sa to extend. As a result, the sheet S is bent in an arch configuration in which the intermediate portion in the widthwise direction Y is convex upward, as illustrated.

The infiltration of water into the image surface Sa is derived from water contained in ink or wetting water which is used for offset printing. Specifically, ink used for stencil printing contains 50% to 70% of water; the water is transferred to the image surface Sa of the sheet. In the case of offset printing, wetting water fed to the surface of a master is transferred to the image surface Sa. As a result, the image surface Sa absorbs the water and is apt to swell. When the bent sheet S is dropped toward a preselected position on a stack tray, it is apt to draw air into the rear thereof opposite to the image surface Sa. The resulting turbulence increases the air resistance of the sheet S and thereby obstructs the smooth fall of the sheet S, i.e., renders the behavior of the sheet S falling toward the stack tray unstable. This often effects the orientation of the edges of the sheet S and increases the period of time necessary for the sheet S to reach the stack tray.

Figure 2A:
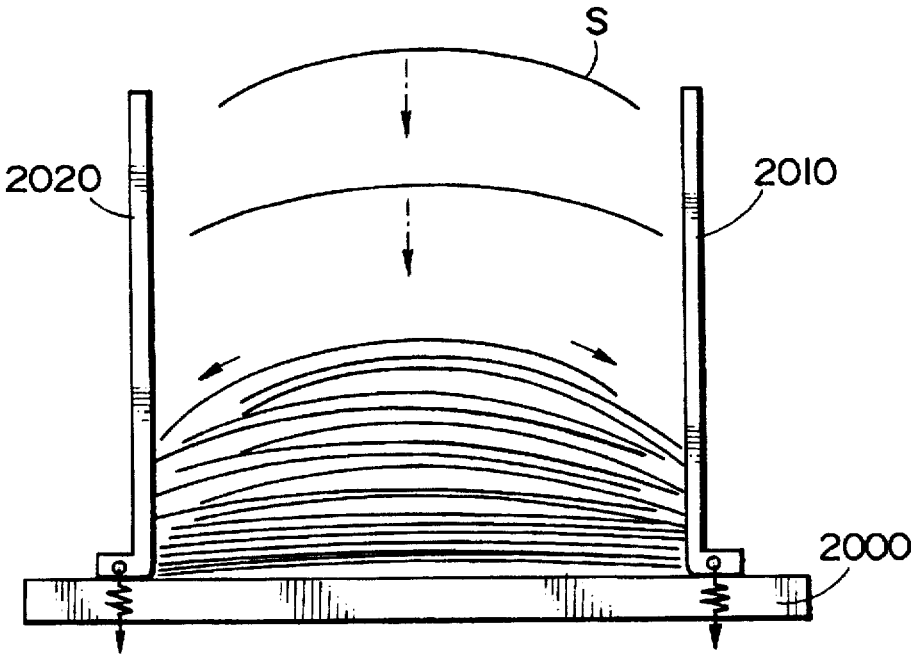
FIG. 2A PRIOR ART
FIGS. 2A and 2B show a conventional sheet discharging device for a printer in a condition in which the number of sheets stacked thereon is small and in a condition in which it is great, respectively.
Figure 2B:
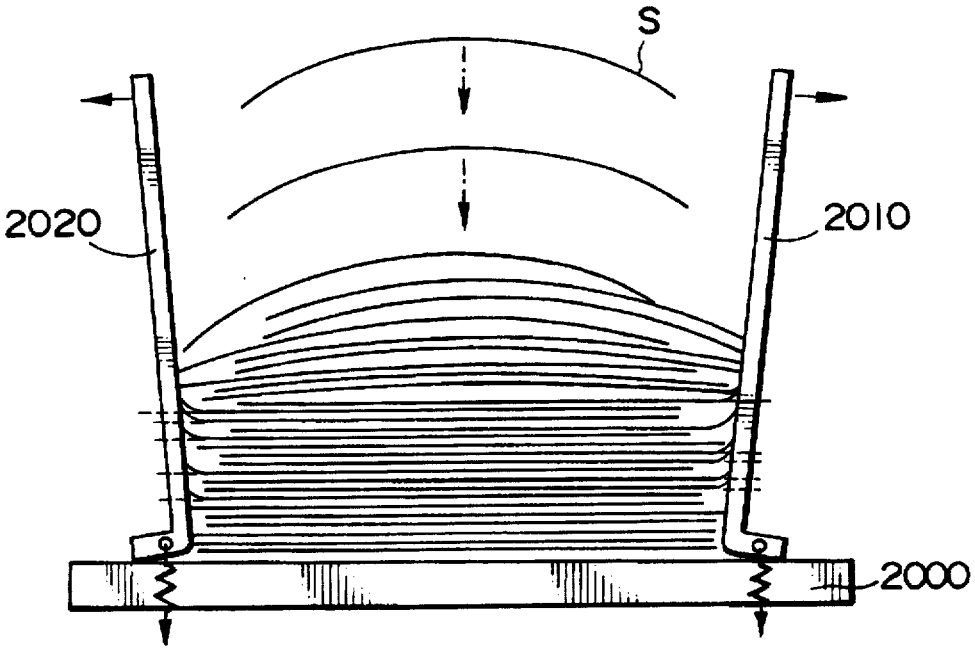
FIG. 2B PRIOR ART

FIGS. 2A and 2B show the sheets S sequentially stacked on a base 2000 included in a stack tray. FIG. 2A is representative of a condition in which thirty to fifty sheets or printings S have been produced after the start of printing. As shown, a pair of side guides 2010 and 2020 are so positioned and fixed in place as to face the widthwise opposite edges of one or two sheets S driven out of the printer and straightened up, i.e., free from the arch deformation. The side guides 2010 and 2020 regulate the opposite edges of the successive sheets S and thereby prevents them from being dislocated during the course of fall.

However, as shown in FIG. 2B, when the number of sheets S stacked on the tray increases, the following sheets S are stacked on the top of the existing stack before they are straightened up. Because the upper sheets S are straightened less than the lower sheets S, the former is shorter in widthwise length than the latter when stacked on the base 2000. In addition, the sheet S with the arch deformation is apt to draw air into the rear thereof during the fall. This obstructs the smooth fall of the sheet S due to the air resistance. Moreover, the sheet S stacked on the deformed sheet S existing on the base 2000 is apt to slip down. Such a sheet S is dislocated with respect to the widthwise center of the sheets S having been straightened up on the base 2000. In this manner, the edges of the sheets S stacked on the base 2000 fail to align with each other.

In the above condition, the sheet S stacked on the base 2000 and having the arch deformation is straightened up due to the weight of the following sheet S with its opposite widthwise edges held in the dislocated condition. As a result, the sheet S with the deformation tends to extend in the widthwise direction, as indicated by phantom lines in FIG. 2B. Consequently, the edges of such sheets S dislocated from the widthwise center of the straightened sheets S abut against and push the side guides 2010 and 2020, thereby causing them to sequentially move away from each other. This further deteriorates the sheet positioning ability of the side guides 2010 and 2020, i.e., further aggravates the misalignment of the edges of the successive sheets S. When the side guides 2010 and 2020 are noticeably moved away from each other, the upper sheets on the base 2000 may even collapse along the inner surfaces of the side guides 2010 and 2020, Prior Art 1 to Prior Art 3 mentioned earlier rely on the characteristic of the side guides 2010 and 2020 in aligning the opposite widthwise edges of the sheets S without regard to the level of the sheets S. However, even with this kind of scheme, it is sometimes impossible to surely align the edges of the sheets or to stabilize the behavior of the sheets S on the base 2000, depending on the number of sheets S.

Figure 3A:
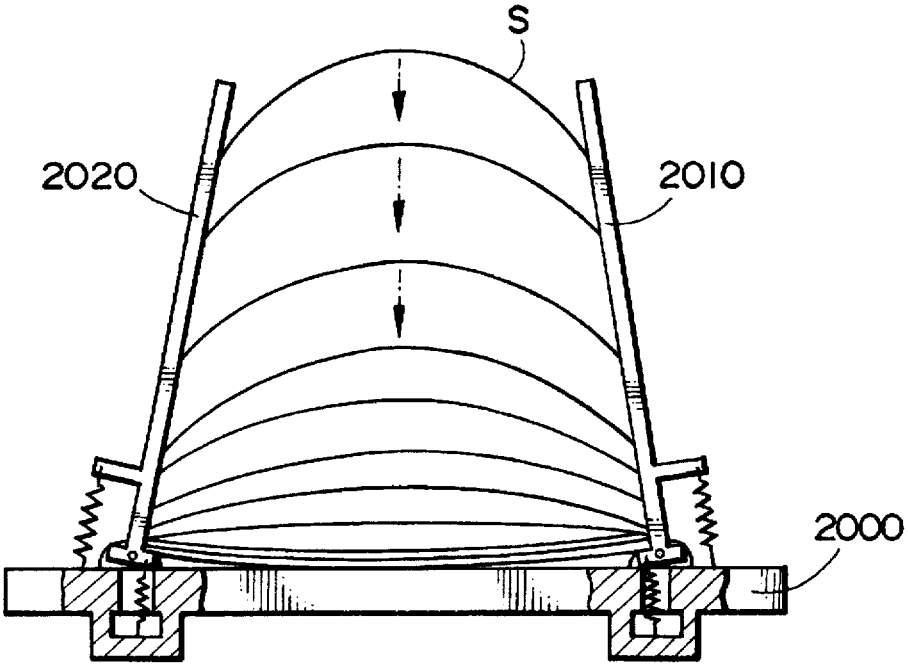
FIG. 3A PRIOR ART
FIG. 3A shows a conventional sheet discharging device proposed to solve the problem of the device shown in FIG. 2A.
Figure 3B:
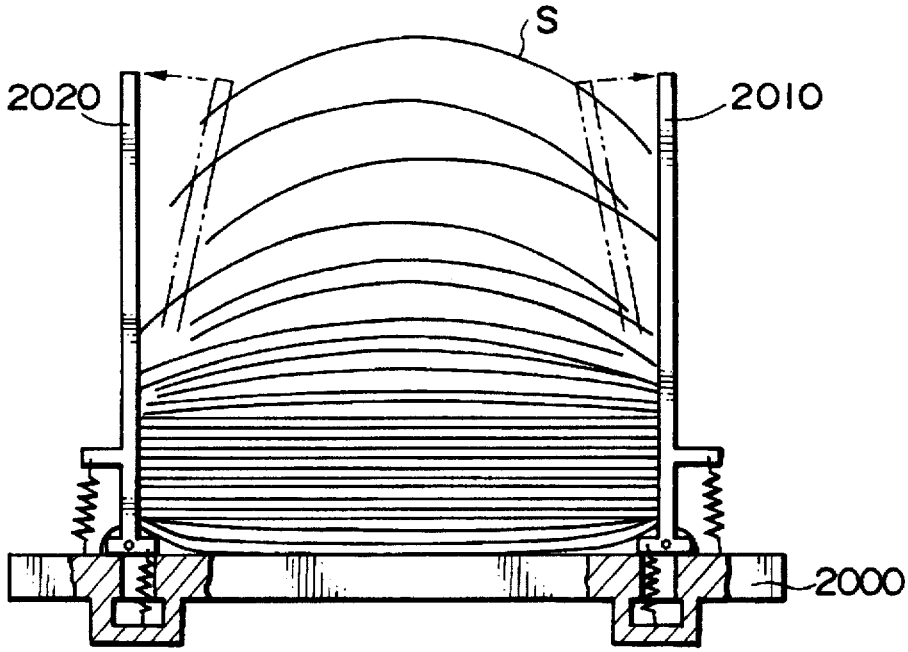
FIG. 3B PRIOR ART
FIG. 3B shows another conventional sheet discharging device proposed to solve the problem of the device shown in FIG. 2B.

Particularly, Prior Art 1 provides the side guides 2010 and 2020 with resiliency in the direction for positioning the edges of the sheets S. So long as the number of sheets stacked on the base 2000 is small, Prior Art 1 is capable of aligning the edges of the sheets S with such side guides 2010 and 2020, as shown in FIG. 3A. However, when the number of sheets S increases, the sheets S existing on the base 2000 and being straightened by the following sheets S push the side guides 2010 and 2020 away from each other, i.e., from positions indicated by dash-and-dots lines in FIG. 3B to positions indicated by solid lines. Therefore, Prior Art 1 also fails to surely align the edges of the following sheets.

Prior Art 2 and Prior Art 3 cannot solve the above problem because they are not configured to straighten up sheets on the surface of the base.

In light of the above, Prior Art 4 and Prior Art 5 teach implementations which straighten up a sheet being stacked without relying on side guides. However, because the side guides of Prior Art 4 and Prior Art 5 are not movable relative to the base, the size of sheets which can be straightened up is limited. This makes it impossible to print images on sheets of various sizes. Moreover, the sheets stacked on the base cannot be easily taken out. Specifically, members for causing the opposite widthwise edges of the sheets to bend backward, i.e., upward are located at a particular level above the base and protrude into the space above the base. These members prevent the sheets from being taken out with ease.

To solve the above problem, an arrangement may be made such that the operator can take out the entire stack of sheets by holding up the bottom of the stack. For example, the stacking portion of the base contacting the bottom sheet may be partly cut away in order to allow the operator to touch the opposite widthwise edges of the bottom sheet. However, the removed portions of the base must be sized great enough to accommodate the person's hands without regard to the sheet size, so that they have a substantial dimension in the widthwise direction of the sheets. This brings about the following problem. The edges of the lower sheets are likely to enter the removed portions of the base due to the weight of the upper sheets. As a result, the edges of the lower sheets easily hang down in the removed portions, causing the overlying sheets to slip down. Consequently, it is difficult to align the edges of the following sheets.

In Prior Art 5, when the sheet fails toward the base, the opposite edges of the sheet are raised relative to the intermediate portion by movable members, so that the entire sheet is deformed in the inverted arch configuration. However, the sheet fallen away from the movable members is again deformed in the original arch configuration partly because ink has not been sufficiently dried. This obstructs the alignment of the edges of the sheets, as discused in relation to Prior Art 1 to Prior Art 3. As a result, the edges of the lower sheets abut against the side guides due to the weight of the upper sheets and thereby move the side guides away from each other. Consequently, the following sheets are apt to slip on the top of the stack and cannot have their edges accurately aligned by the side guides. When the base itself is provided with an inverted arch configuration, the sheets can be deformed complementarily to the base without relying on the side guides. However, this kind of scheme is not adaptive to sheets of various sizes and obstructs the removal of the sheet stack.

In addition, the stack tray constantly protrudes outward from the wall of the printer. The stack tray is therefore obstructive when the printer is not used.

Figure 4:
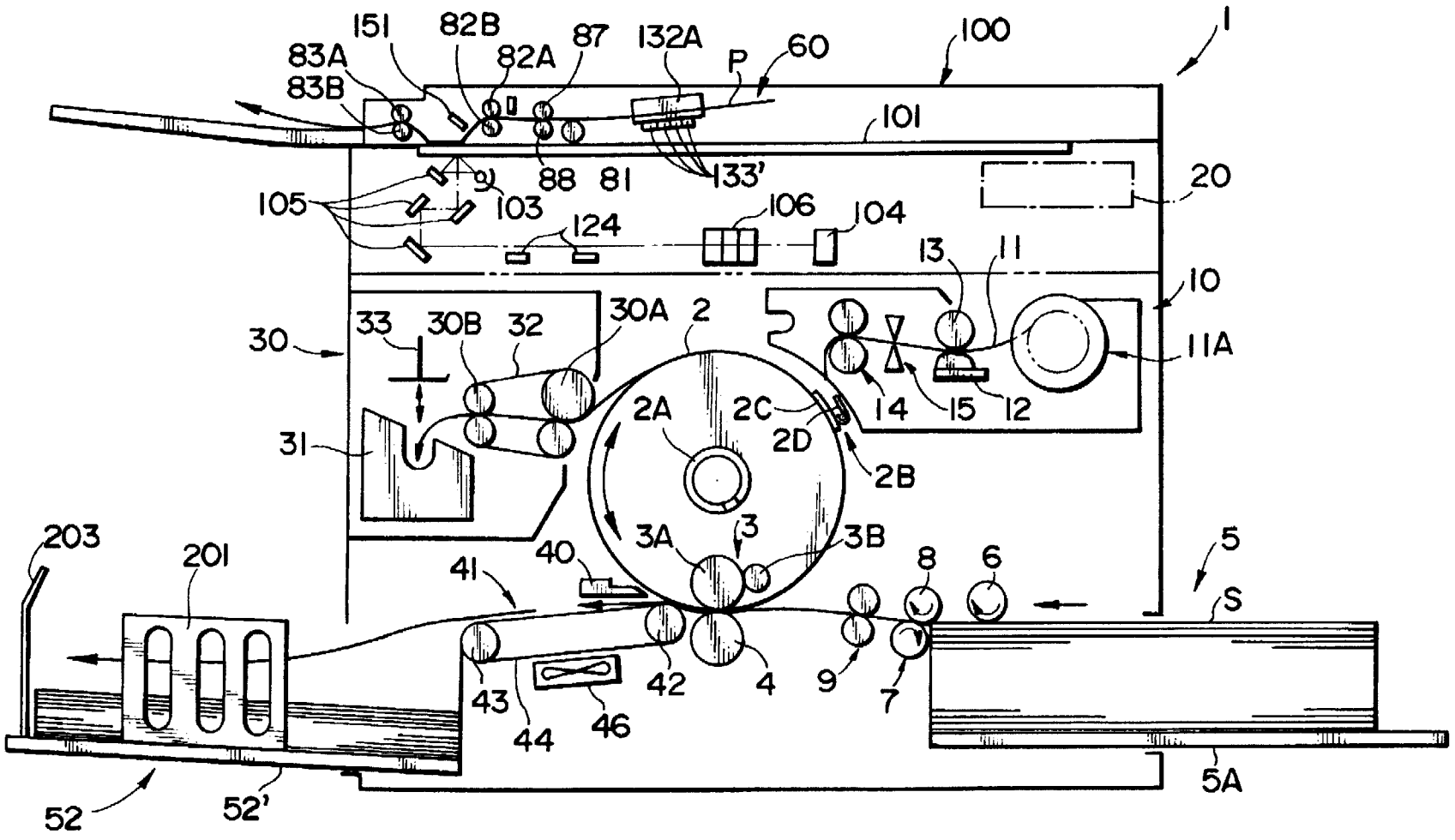
FIG. 4 is a view showing a stencil printer to which the present invention is applicable.

Referring to FIG. 4, a printer to which the present invention is applicable is shown and implemented as a stencil printer by way of example. As shown, the printer, generally 1, has a drum 2 rotatable in opposite directions about a shaft 2A. Specifically, the drum 2 is rotated clockwise during the course of printing or rotated counterclockwise when a perforated stencil or so-called master 11 used is to be discharged. The drum 2 is formed with a number of pores in its periphery except for a part thereof. A mesh screen, not shown, is fitted on the surface of the drum 2 and implemented as a thin layer of, e.g., synthetic fibers. The synthetic fibers may be replaced with metal, if desired.

A clamper 2B is mounted on the above-mentioned part of the drum 2 where the pores are absent, and is made up of a stage 2C and a clamping member 2D. The stage 2C is formed of a magnetic material and has a surface extending parallel to the axis of the drum 2. The clamping member 2D is pivotable toward and away from the stage 2C. After the leading edge of the master 11 has been laid on the above surface of the stage 2C, the clamping member 2D clamps it in cooperation with the stage 2C. The other part of the master 11 is adhered to the surface of the drum 2 due to the viscosity of ink fed toward the surface of the drum 2 from an ink supply mechanism 3.

The ink supply mechanism 3 is disposed in the drum 2 and positioned beneath the shaft 2A. An ink roller 3A and a doctor roller 3B are the major constituents of the mechanism 3. The ink roller 3A is a metallic roller facing a press roller 4 which will be described. The ink roller 3A is rotated at a speed synchronous to the peripheral speed of the drum 2 in contact with the inner periphery of the drum 2. Ink is fed to the pores of the drum 2 and mesh screen while being regulated in amount by the doctor roller 3B. Specifically, the ink is dropped from an outlet formed in the shaft 2A into a generally wedge-shaped ink well formed between the ink roller 3A and the doctor roller 3B. The ink roller 3A facing the press roller 4 plays the role of a back-up roller at the same time; that is, when the press roller 4 is pressed against the drum 2, the roller 3A prevents the drum 2 from deforming.

The press roller 4 is movable into and out of contact with the drum 2. When a sheet S is fed from a registration roller pair 9, which will be described, to between the drum 2 and the press roller 4, the roller 4 presses the sheet S against the surface of the drum 2. When the sheet S is pressed against the drum 2 by the press roller 4, the ink is transferred from the drum 2 to the sheet S via the perforations of the master 11. In this sense, the press roller 4 constitutes an image transfer station.

A sheet feeding device 5 is located in the vicinity of the press roller 4 and includes a cassette 5A loaded with a stack of sheets S. A pick-up roller 6 is movable into and out of contact with the top sheet of the cassette 5A and used to feed it in a direction indicated by an arrow in FIG. 4. A pair of separation rollers 7 and 8 face each other with the intermediary of a sheet feed path and rotate in directions for separating the top sheet S picked up by the pick-up roller 6 from the underlying sheets S. The registration roller pair 9 stops the sheet S fed from the cassette 5A and then drives it toward the image transfer station at a preselected timing. Specifically, when the press roller 4 is brought into contact with the drum 2, the roller pair 9 drives the sheet S such that the print start position on the sheet S meets the image position on the master 11.

A master making section 10 and a master discharging section 30 are disposed above the drum 2 at the opposite sides of a vertical line extending through the axis of the drum 2. The master making section 10 has the stencil 11 wound round a core 11A in the form of a roll. The stencil 11 has a laminate structure consisting of a thermoplastic resin film which is as thin as 1 μm to 2 μm, and a porous support to which the film is adhered. The porous support is formed of Japanese paper or synthetic fibers or a combination thereof.

The stencil 11 paid out from the roll is pressed against a thermal head 12 by a platen roller 13. Then, heating elements included in the thermal head 12 selectively generate heat and thereby perforate the stencil 11 in the main and subscanning directions. It is to be noted that the main scanning direction is the axial direction of the platen roller 13 while the subscanning direction is the direction perpendicular to the main scanning direction and in which the stencil 11 is paid out from the roll. The heating elements of the head 12 to generate heat are selected by current control executed by a control section 20 and using a drive signal.

A stepping motor or similar drive source, not shown, rotates the platen 13 stepwise, thereby causing it to convey the stencil 11 in the subscanning direction. A conveyor roller pair 14 is located downstream of the platen roller 13 in the direction in which the stencil 11 is paid out from the roll. The conveyor roller pair 14 conveys the stencil 11 coming out of the platen roller 14 and thermal head 12. The roller pair 14 can be interlocked to the above stepping motor via a torque limiter, not shown, and is rotated at such a speed that the roller pair 14 conveys the stencil 11 at a slightly higher speed than the platen roller 13. The difference in speed between the platen roller 13 and the roller pair 14 causes a tension predetermined by the torque limiter to act on the stencil 11 over the range between the head 12 and the roller pair 14. Hence, the stencil 11 is free from slackening and creasing at the position where it is pressed against the head 12 by the platen roller 13.

The part of the stencil 11 perforated by the head 12 is cut in a preselected length by a cutter 15 to turn out a master. The master 11 is conveyed in a direction tangential to the drum 2 until its leading edge has been clamped by the clamper 2B. As shown in FIG. 4, the cutter 15 has a stationary edge positioned on the stencil transport path, and a movable edge movable up and down relative to the stationary edge. Such a guillotine type cutter may be replaced with a rolling type cutter made up of a stationary edge and a rotary edge rotatable relative to the stationary edge.

An image reading device 100 is arranged in the upper portion of the printer 1. The device 100 has a glass platen 101 mounted on the top of the printer body, an image scanning section located below the glass platen 101, and an automatic document feeder (ADF) above the glass platen 101. The image scanning section is movable back and forth in the lengthwise direction of the glass platen 101. The image scanning section has a light source 103 for illuminating a document P laid on the glass platen 101, and a plurality of mirrors 105 and a magnification change lens 106 defining an optical path for focusing a reflection from the document P to a CCD (Charge Coupled Device) image sensor 104. The optics consisting of the mirrors 105 and lens 106 causes each mirror to move at a particular speed, as has been customary with this kind of image forming apparatus. Document size sensors 124 are positioned below the glass platen 101 in order to sense the size of the document laid on the platen 101. The sensors 124 are implemented by reflection type photosensors, and each is assigned to a particular regular sheet size.

The ADF also conventional with this kind of image forming apparatus has a stacking section 60 for stacking documents P. A pick-up roller 81 feeds one document P from the stacking section 60 at a time. Also included in the ADF are a plurality of rollers 82A, 82B, 83A and 83B for conveying the document P, and separation rollers 87 and 88 for separating the document P from the other documents. The document P fed from the stacking section 60 is positioned on the glass platen 101 and then scanned by the previously stated optics. The document P has its widthwise dimension sensed on the stacking section 60 and has its lengthwise dimension sensed on the transport path. Specifically, a reflection type photosensor 151 is located on the transport path in order to sense the lengthwise dimension of the document P.

Figure 5A:
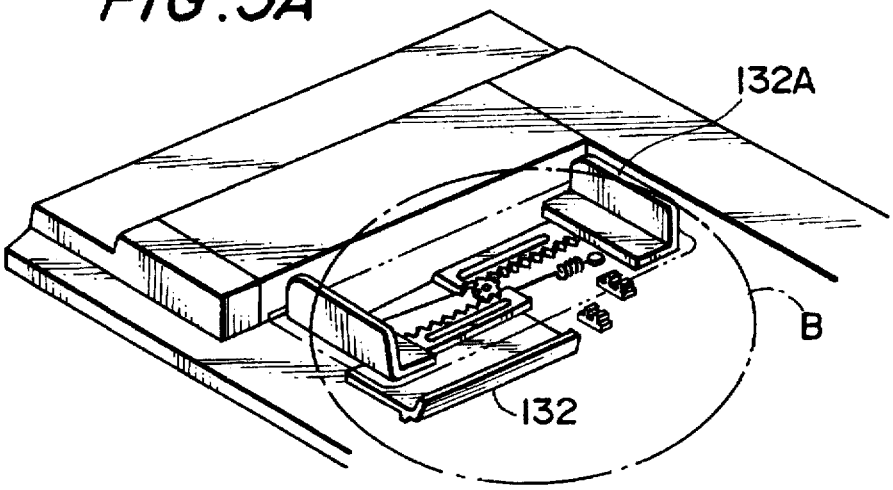
FIG. 5A is a perspective view showing a mechanism included in the printer of FIG. 4 for sensing the size of documents in a document reading section.
Figure 5B:
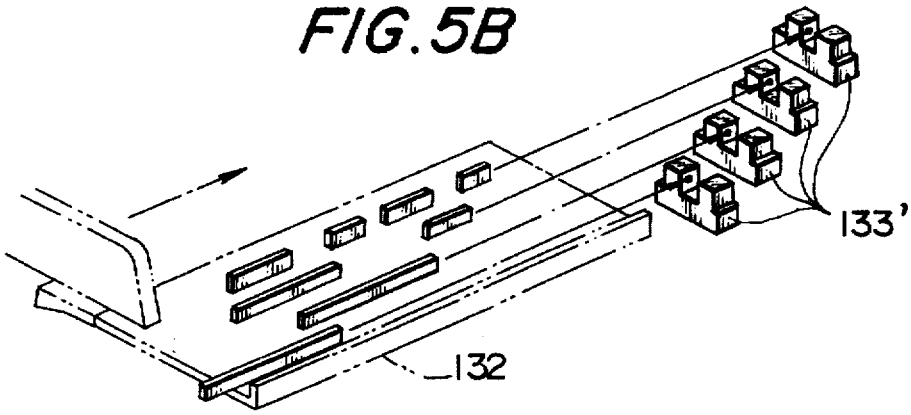
FIG. 5B is a fragmentary perspective view showing a portion B of FIG. 5A in detail.

As shown in FIGS. 5A and 5B, A pair of side guides 132A are provided on the stacking section 60 and movable to position the opposite side edges of the documents P. To sense the widthwise dimension of the documents P, a screen member 132 is mounted on one of the side guides 132A and has a plurality of screening sections on the underside thereof. Because the side guides 132A are movable toward and away from each other via a gear located at the center in the widthwise direction, the screen member 132 should only be mounted on one of them. Transmission type photosensors 133' are mounted on a stationary member, not shown, and each is assigned to a particular regular size regarding the width. In this configuration, when the side guide 132A with the screen member 132 is moved, one of the photosensors 133' has its optical path obstructed by any of the screening sections of the member 132. The resulting output of the above photosensor 133' is indicative of the widthwise dimension of the documents P. The screening portions are arranged in the lengthwise direction in consideration of changes in the lengthwise dimension of documents.

Referring again to FIG. 4, the CCD image sensor 104 transforms the reflection from the document P to corresponding image data and sends them to the control section 20. The control section 20, although not shown specifically, receives information relating to the size of documents and that of sheets S in addition to the image data output from the CCD 104. In response, the control section 20 controls a driver for driving the thermal head 12, the selection of the sheets S, etc.

The control section 20 controllably drives the thermal head 12 via the driver in accordance with an image forming mode, e.g., a magnification change mode or a mode for forming a plurality of pictures on the same side of a single sheet S. For example, the control section 20 forms a 1:1 image or an image with a different magnification in matching relation to the size of the sheet S, and sets up a magnification change ratio for the combination of a plurality of images.

Figure 6:
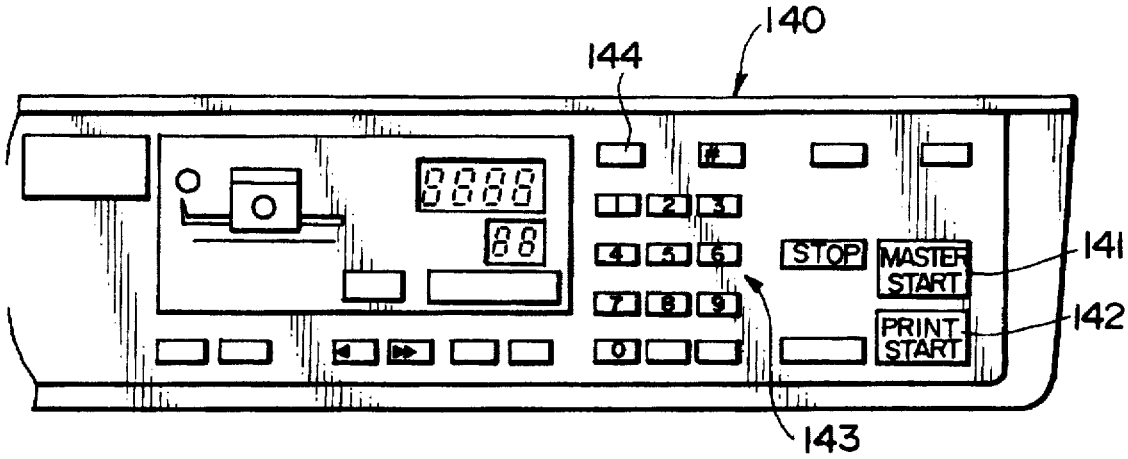
FIG. 6 is a fragmentary external view showing a specific configuration of an operation panel mounted on the printer of FIG. 4.

FIG. 6 shows a specific arrangement of an operation panel 140 accessible for, e.g., selecting a desired sheet size, setting a desired number of printings, inputting a trial print command before actual printing, and inputting a print start command. As shown, the operation panel 140 has a master start switch 141, a print start switch 142, numeral keys 143 for inputting a desired number of printings, and a switch 144 for inputting the size or dimensions of documents. The switch 144 is used to input the size or dimensions of documents by hand when document size sensors, which will be described, are not available. The size of sheets S, which is another size information, is input via an arrangement which will be described with reference to FIGS. 7A and 7B.

Figure 7A:
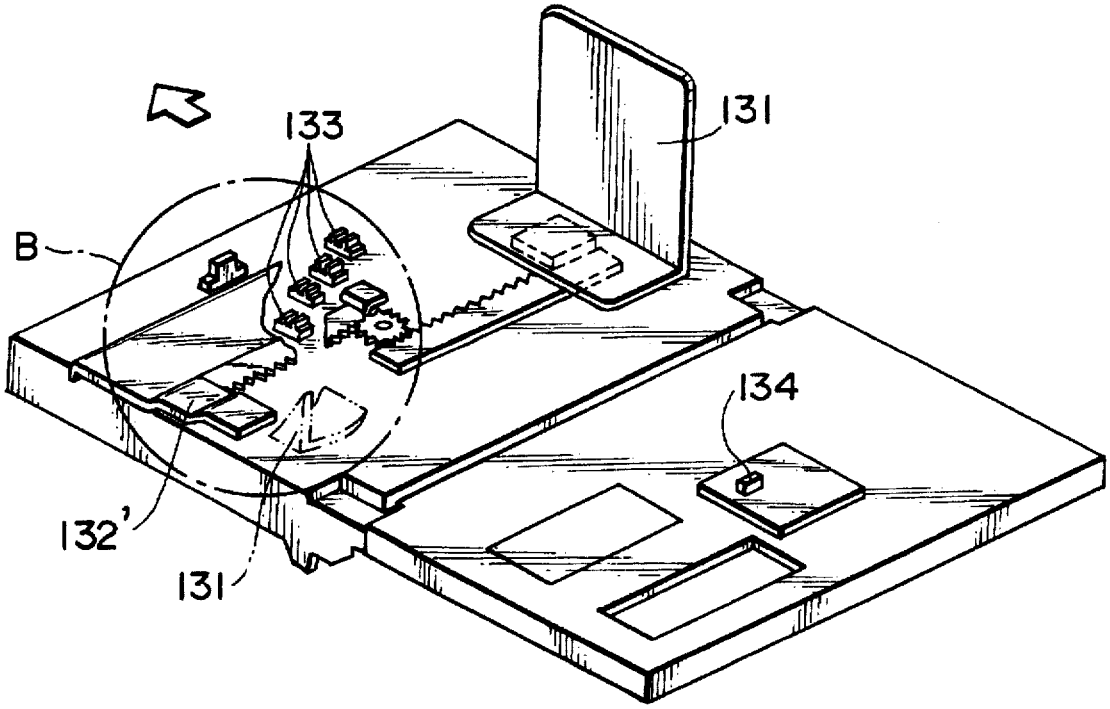
FIG. 7A is a perspective view of a mechanism included in the printer of FIG. 4 for sensing the size of sheets.
Figure 7B:
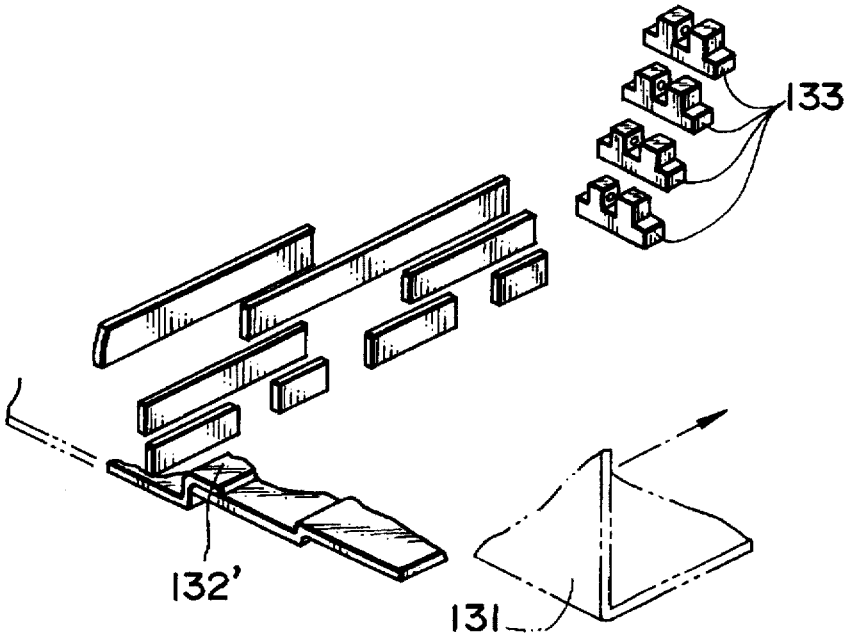
FIG. 7B is a fragmentary perspective view showing a portion B of FIG. 7A in detail.

As shown in FIGS. 7A and 7B, a pair of guide fences 131, like the side guides 132A, FIGS. 5A and 5B, are mounted on a sheet feed tray and slidable toward and away from each other in the widthwise direction of the sheets S, i.e., perpendicularly to the direction in which the sheets S are conveyed (indicated by an arrow). A screen member 132' is mounted on one of the guide fences 131 and has a plurality of screening sections on the underside thereof. The screen member 132', like the screen member 132, corresponds in position to a plurality of transmission type photosensors 133. The photosensors 133 are mounted on a stationary member, not shown, and each is assigned to a particular regular size regarding the width. The screen member 132' and photosensors 133 are used to sense the widthwise size of the sheets S. In addition, a reflection type photosensor 134 is mounted on the sheet feed tray in order to sense the lengthwise size of the sheets S parallel to the direction of sheet conveyance. The photosensor 134 determines the length of the sheets S by counting the time in which a reflection from the sheets S is incident thereto.

By sensing the size of the documents P and that of the sheets S and comparing them, it is possible to, e.g., obviate areas where images cannot be printed, to set a magnification change characteristic for the formation of a plurality of images on the same side of a single sheet S, and to determine whether or not such a characteristic can be set.

Referring again to FIG. 4, the master discharging section 30 has two pairs of rollers 30A, rollers 30B, and belts 32. In each pair, the belt 32 is passed over the roller 30A movable toward and away from the drum 2, and the roller 30B adjoining a waste master box 31. When the drum 2 is rotated counterclockwise, the belts 32 receive the rear edge of the used master 11 and conveys it toward the waste master box 31. A compressing member 33 is disposed above the box 31 and movable up and down. When the compressing member 33 is moved downward, it compresses the master 11 received in the box 31 so as to prepare a space for the next waste master 11. When the box 31 is filled with such waste masters 11, the box 31 is removed from the printer 1 to discard the masters 11.

A sheet separator 40 is located downstream of the position where the drum 2 and press roller 4 face each other with respect to the clockwise rotation of the drum 2. The sheet separator 40 is movable toward and away from the drum 2 and separates, when moved into contact with the drum 2, the sheet S from the drum 2 and guides it toward an outlet conveying device 41. The outlet conveying device 41 has an endless belt 44 passed over a pair of rollers 42 and 43 and conveys the sheet S separated from the drum 2 to a stack tray 52. A suction fan 46 is positioned below the belt 44 in order to suck the sheet S being conveyed by the belt 44.

The printer 1 having the above construction is operated as follows. First, the drum 2 is rotated counterclockwise. At this time, the used master 11 wrapped around the drum 2 is hipped by the belts 32 and then conveyed toward the waste master box 31 while being sequentially removed from the drum 2. Subsequently, when the drum 2 is rotated clockwise, the ink existing in the ink well of the ink supply mechanism 3 is kneaded by the doctor roller 3B and transferred to the ink roller 3A. Then, the ink sequentially infiltrates into the mesh screen of the drum 2.

In the maser making section 10, the heating elements of the thermal head 12 are selectively energized under the control of the control section 20 in response to the image data output from the image reading section 100. As a result, the head 12 perforates the stencil 11 in accordance with the image data. The perforated stencil or master 11 is wrapped around the drum 2 with its leading edge clamped by the clamper 2B. The registration roller pair 9 drives the sheet S toward the image transfer station where the mechanism 3 is located, in synchronism with the movement of the stencil 11 to the image transfer station. The press roller 4 presses the sheet S against the drum 2 with the intermediary of the sheet S. As a result, the ink is transferred from the mesh screen of the drum 2 to the sheet S via the perforations of the stencil 11, thereby printing an image on the sheet S. The sheet S with the image, e.g., a printing is driven out to the stack tray 52 by the outlet conveying device 41.

The stack tray 52 constitutes a preferred embodiment of the sheet discharging device in accordance with the present invention, as follows.

Figure 8:
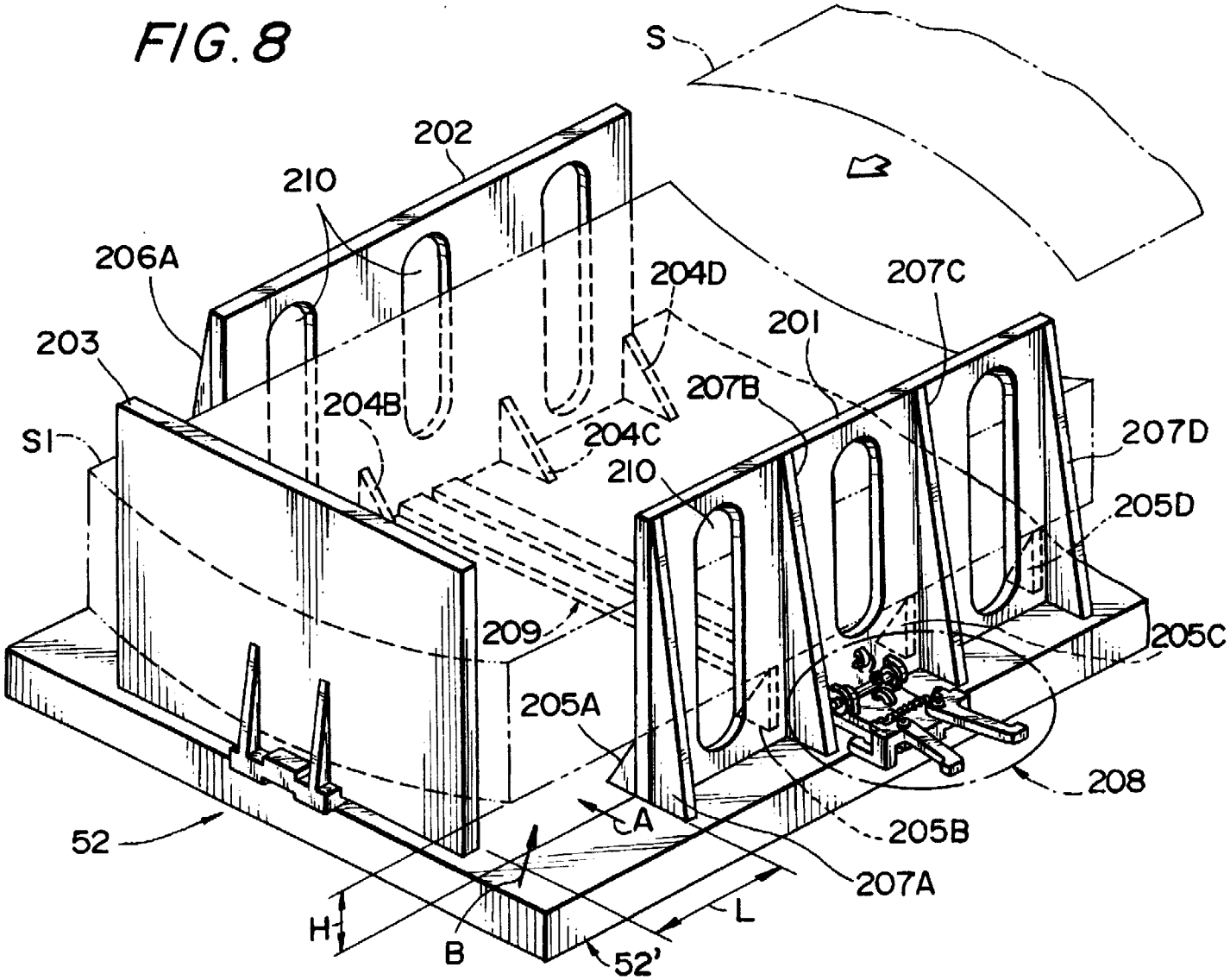
FIG. 8 is a perspective view showing a sheet discharging device for a printer and embodying the present invention.

Referring to FIG. 8, the stack tray 52 has a flat base 52', a pair of side fences 201 and 202, and an end plate 203. The side fences and end plate 203 are mounted on the base 52' perpendicularly to the surface of the base 52'. The side fences 201 and 202 face each other in the widthwise direction of the sheets S, i.e., in the direction perpendicular to the direction of sheet conveyance. The side fences 201 and 202 are movable toward and away from each other in the widthwise direction of the sheets S while facing the opposite edges of the sheets S. A slide rail 209 is mounted on the stacking surface of the base 52' and engaged with the bottoms of the side fences 201 and 202 so as to allow the fences 201 and 202 to move. The slide rail 209 is implemented by an elongate projection extending in the widthwise direction of the sheets S on the base 52'. The side fences 201 and 202 are each formed with a notch on its bottom which mates with the projection of the slide rail 209. The side fences 201 and 202 are each locked in position in the widthwise direction of the sheets S by a respective locking portion 208 which will be described in detail later.

The side fences 201 and 202 each includes an inclined portion adjoining the base 52' in the vertical direction. The inclined portions of the side fences 201 and 202 are respectively constituted by ribs 204A–204D (204A is not visible in FIG. 8) and ribs 205A–205D. The ribs 204A–204D and 205A–205D are respectively formed on the inner surfaces of the side fences 202 and 201 facing each other in the widthwise direction of the sheets S.

Specifically, the ribs 204A–204D are positioned on the lower portion of the side fence 202 and spaced in the direction in which the sheets S are sequentially discharged onto the tray 52 (indicated by an arrow). The ribs 204A–204D protrude toward the center of the sheets S in the widthwise direction from the upper portion to the lower portion of the side fence 202. The ribs 205A–205D are identical in configuration with the ribs 204A–204D except that they are provided on the other side fence 201. The ribs 204A–204D and 205A–205D each has an inclined surface or inclined ridge line extending toward the stacking surface of the base 52', and a bottom contacting the stacking surface. Hence, when the ribs 204A–204D and 205A–205D are seen in the direction indicated by the arrow in FIG. 8, each of them has a triangular shape having a height H.

Because all the ribs 204A–204D and 205A–205D have the same height H, the point or the line where they intersect the side fences 202 and 201 are parallel to the direction in which the sheets S are discharged. Hence, when the sheet S is dropped onto the stacking surface of the base 52', the ribs 204A–204D and 205A–205D raise the opposite widthwise edges of the sheet S. As a result, the sheet S is bent in the inverted arch configuration in the widthwise direction thereof.

Ribs or outer ribs 206A–206D (206B–206D are not visible) and 207A–207D are respectively provided on the outer surfaces of the side fences 202 and 201 opposite to the surfaces where the ribs or inner ribs 204A–204D and 205A–205D are provided. Preferably, the number of the outer ribs 206A–206D and 207A–207D should be equal to or greater than the number of the inner ribs 204A–204D and 205A–205D. Each of the outer ribs 206A–206D and 207A–207D protrudes outward from the side fence 202 or 201 while being sequentially inclined downward, and has a triangular shape as seen in the direction of sheet discharge.

Figure 9A:
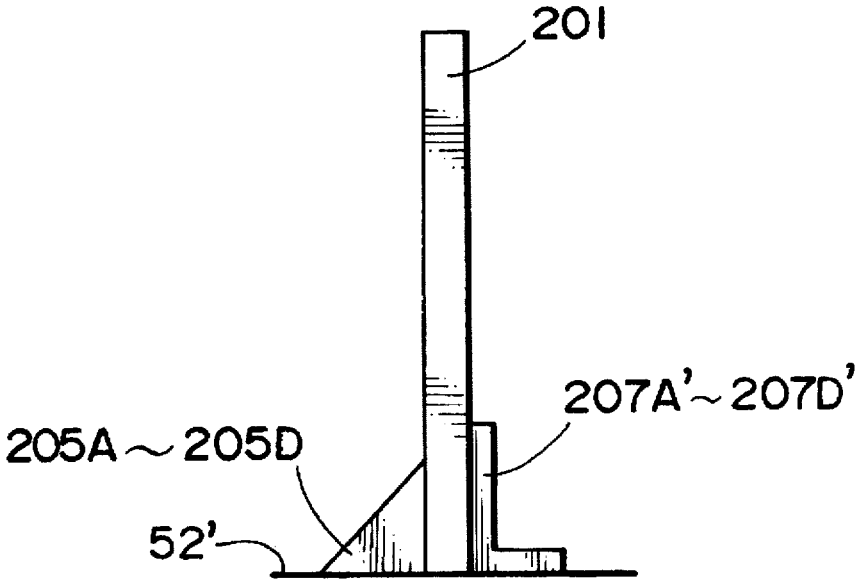
FIGS. 9A and 9B each shows a particular modification of the embodiment.
Figure 9B:
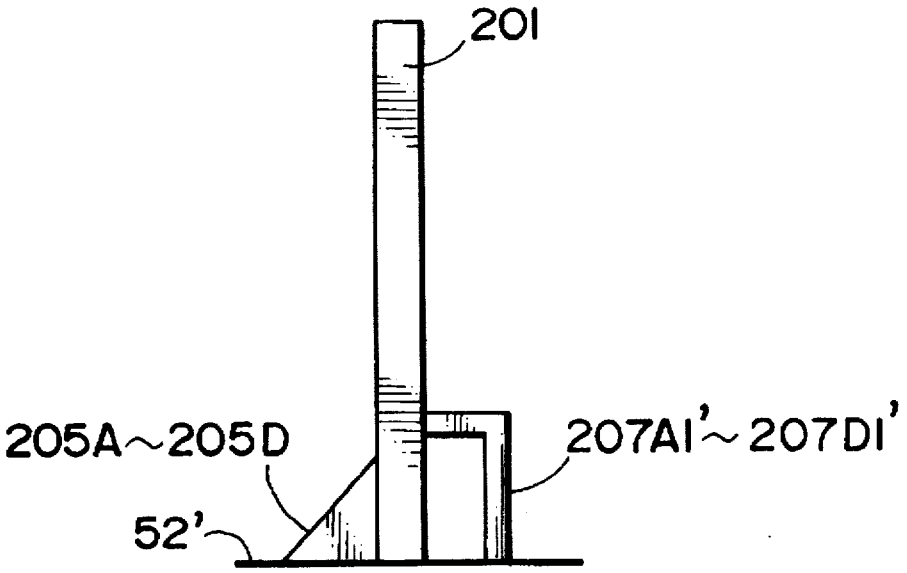

The outer ribs 206A–206D and 207A–207D prevent the side fences 202 and 201 from falling down outward about their lower ends, i.e., play the role of stops. The ribs 206A–206D and 207A–207D contact the stacking surface of the base 52' at their lower ends. The upper ends of the ribs 206A–206D and 207A–207D are located at substantially the same level as the side fences 202 and 201. However, the gist is that the ribs 206A–206D and 207A–207D have bottoms contacting the stacking surface of the base 52' and prevent the side fences 202 and 201 from falling down. FIGS. 9A and 9B show other specific configurations of the ribs 206A–206D and 207A–207D satisfying the above gist. In FIG. 9A, a piece (labeled 207A'–207D') angled in the form of a letter "L" is positioned upright such that one or longer portion is joined with the outer surface of the side fence 201 (or 202) while the other or shorter portion contacts the stacking surface. In FIG. 9B, the angled piece (labeled 207A1'–207D1') is inverted such that the shorter portion is joined with the outer surface of the side fence 201 (or 202) while the longer portion contacts the stacking surface. In any case, the position or the area at or over which the angled piece contacts the stacking portion should preferably be so selected as to prevent the side fences 201 or 202 from failing down, as stated above in relation to the ribs 206A–206D and 207A–207D.

The side fences 201 and 202 are each formed with a plurality of slots 210 extending in the vertical direction and spaced in the direction of sheet discharge. The slots 210 allow air to flow out of the space above the stacking surface of the base 52' therethrough. This successfully reduces air resistance when the sheet S falls toward the base 52'.

The end plate 203 is positioned at the front end of the base 52' with respect to the direction of sheet discharge. The end plate 203 is spaced from the front ends of the side fences 201 and 202 by a distance L in the direction of sheet discharge, as shown in FIG. 8. The leading edge of the sheet S driven out of the printer 1 abuts against the end plate 203 and is positioned thereby. The end plate 203 is movable in the direction of sheet discharge to a position matching the length of the sheet S, although not shown specifically.

The distance L between the end plate 203 and the front ends of the side fences 201 and 202 changes with a change in the position of the end plate 203. However, the distance L can be restored to a distance great enough for the operator to take out the sheets S. For example, assume that the end plate 203 has been moved in the direction in which the distance L deceases. Then, after the discharge of the sheets S onto the tray 52, the end plate 203 is returned to a position where the distance L is great enough for the operator to take out the sheets S. In this manner, a space for taking out the sheets S is guaranteed. In the illustrative embodiment, the distance L is great enough to accommodate the operator's fingers, i.e., at least 40 mm to 50 mm. Of course, greater distances L will further facilitate the removal of the sheet stack.

Figure 10:
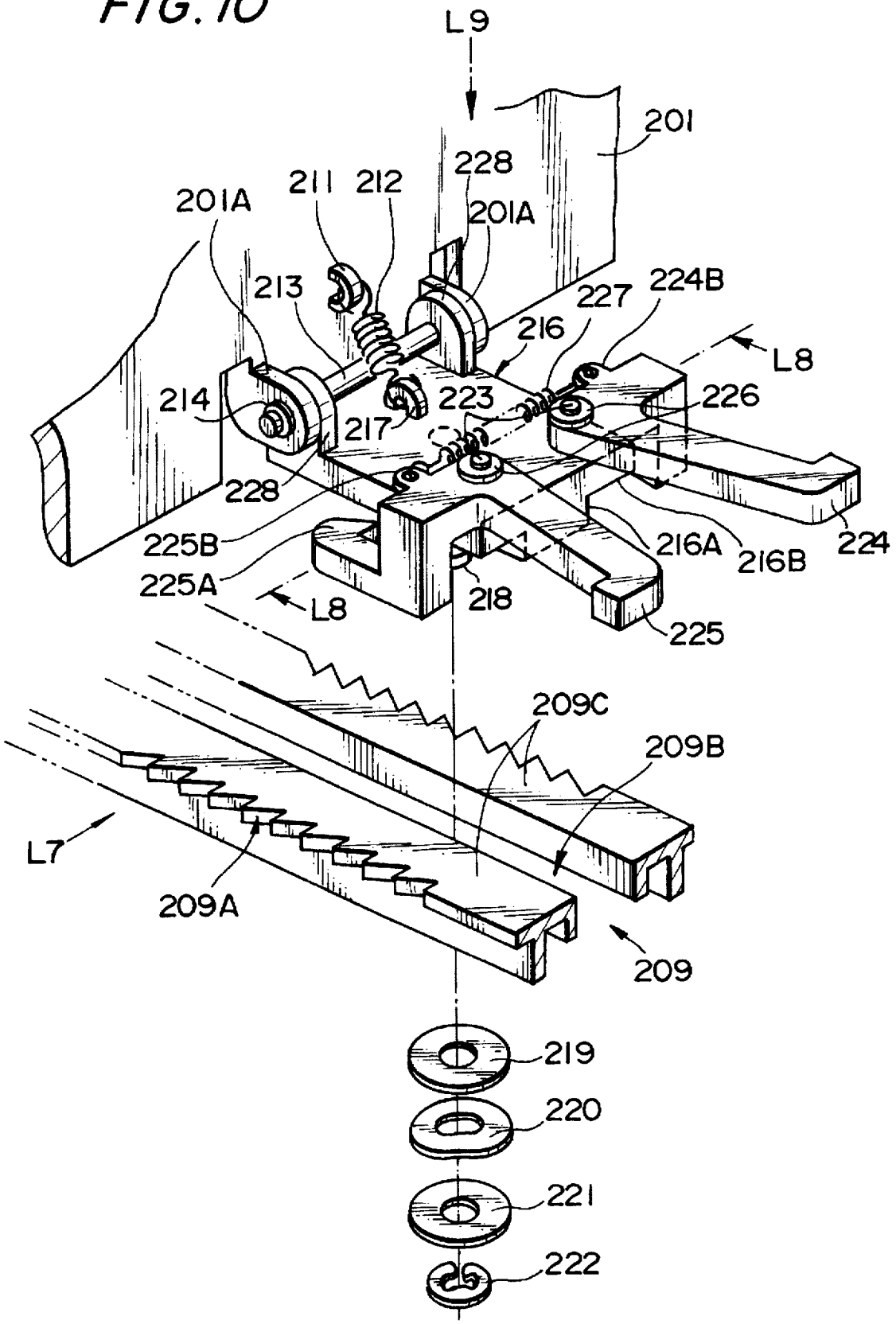
FIG. 10 is a fragmentary enlarged view of the device shown in FIG. 8.

After the side fences 201 and 202 have been positioned in the widthwise direction of the sheet S, they are each locked in position by the respective locking portion 208. FIGS. 10–13 show the locking portion 208 in detail. As shown in FIG. 10, the locking portion 208 is constructed integrally with the side fence 201 (or 202) and slidable on and along the slide rail 209. A shaft 213 is mounted on the outer surface of the side fence 201 in close proximity to the bottom of the fence 201. A slider 216 is supported by the shaft 213. The shaft 213 is passed through bracket-like bearings 201A and 228 which are included in the side fence 201 and slider 216, respectively. Stop rings 214 are fitted on opposite ends of the shaft 213 in order to prevent it from slipping out. A hook 211 is formed on the outer surface of the side fence 201. Likewise, a hook 217 is formed on the upper surface of the slider 216 in close proximity to the shaft 213. A tension spring 212 is anchored to the hooks 211 and 217 at opposite ends thereof.

Figure 11:
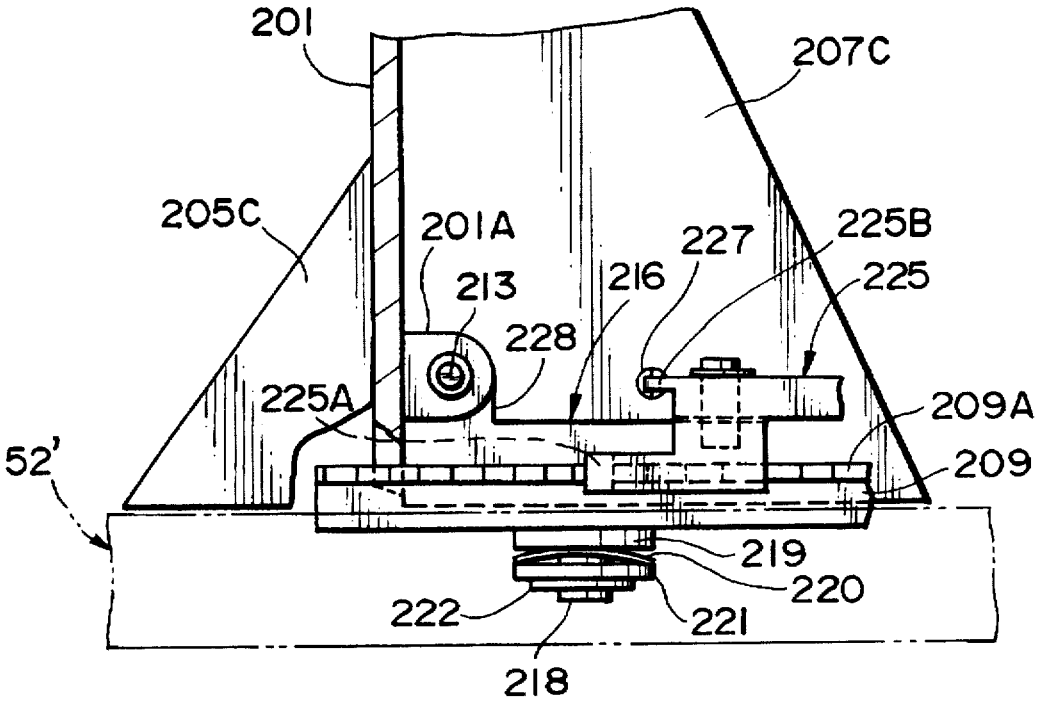
FIGS. 11, 12 and 13 are views as respectively seen in directions L7, L8 and L9 shown in FIG. 10.
Figure 12:
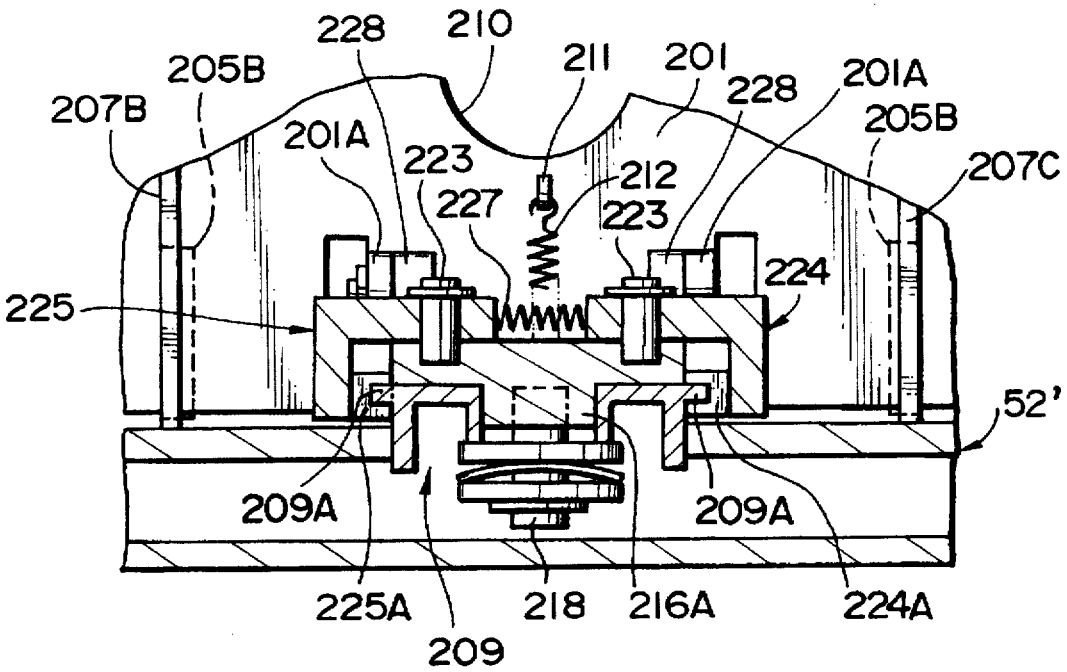

A lug 216A protrudes downward from the underside of the slider 216 and is received in a channel 209B formed in the slide rail 209. A rod 218 extends downward from the bottom of the lug 216A. As shown in FIGS. 11 and 12, the rod 218 extends throughout the channel 209B of the slide rail 209. A spacer 219 great enough to cover the channel 209B, a spring washer 220, a spacer 221 and a stop ring 222 are sequentially fitted on the lower end of a rod 218 in this order, thereby preventing the rod 218 from slipping out of the channel 209B. Portions 216B of the bottom of the slider 216 sandwiching the lug 216A rest on slide surfaces 209C of the slide rail 209 and are slidable thereon in the widthwise direction of the sheet S. The spring washer 220 fitted on the rod 218 exerts an adequate degree of pressure between the spacer 219 and the channel 216B, thereby causing friction to act between the slider 216 and the slide rail 209.

A mechanism for locking the slider 216 in the widthwise direction of the sheet S includes teeth 209A formed in the slide rail 209, and arms 224 and 225 provided on the upper surface of the slider 216 and capable of mating with the teeth 209A. Specifically, the teeth 209A are formed in the opposite edges of the slide rail 209 in the direction of sheet discharge. The arms 224 and 225 are rotatably mounted on the slider 216 by a pair of shafts 223.

Figure 13:
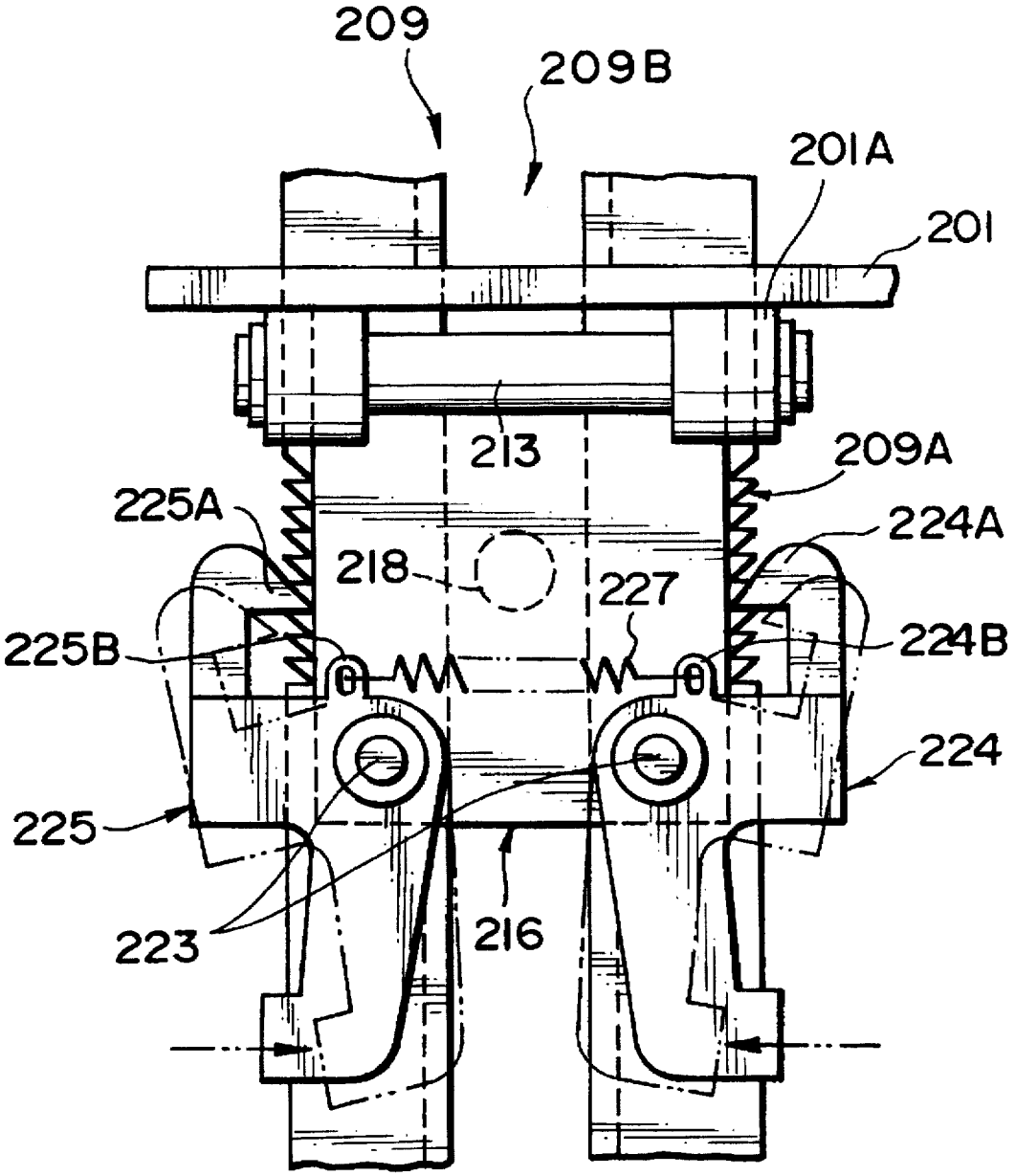

As shown in FIG. 13, the arms 224 and 225 respectively have pawls 224A and 225A at one end thereof with respect to the shafts 223. The pawls 224A and 225A are capable of meshing with the teeth 209A of the side rail 209. Hooks 224B and 225B are respectively formed on the above ends of the arms 224 and 225 while a tension spring 227 is anchored to the hooks 224B and 225B at opposite ends thereof. Therefore, the arms 224 and 225 are constantly biased such that the pawls 224A and 225B usually mesh with the teeth 209A. In the illustrative embodiment, the teeth 209A are so oriented as to prevent the slider 216, i.e., the side fence 201 from moving outward in the widthwise direction of the sheet S when the pawls 224A and 225A mesh therewith.

The other ends of the arms 224 and 225 with respect to the shafts 223 serve as thumb pieces for releasing the pawls 224A and 225A form the teeth 209A against the action of the tension spring 227. When these ends of the arms 224 and 225 are urged toward each other, as indicated by arrows in FIG. 13, the pawls 224A and 225A are released from the teeth 209A. Then, the slider 216 is freely movable relatively to the slide rail 209. Hence, the operator is capable of moving the slider 216 to a position where the side fence 201 will face one edge of the sheet stack S.

Figure 14A:
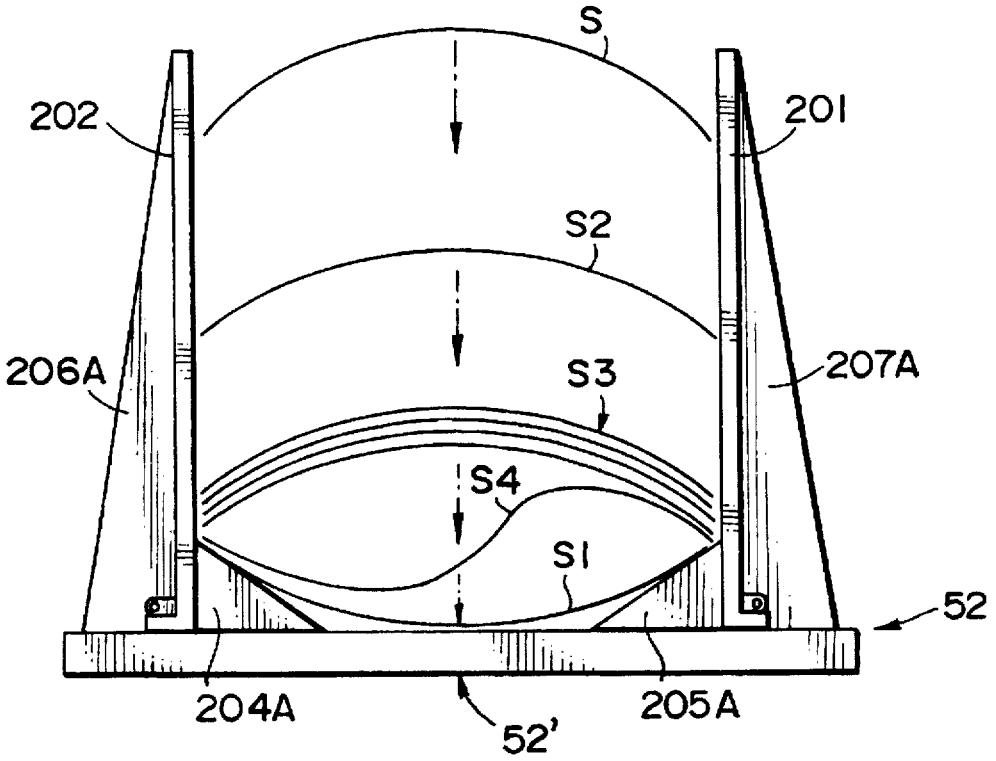
FIGS. 14A and 14B show the device of FIG. 8 in a condition in which the number of sheets stacked thereon is small and in a condition in which it is great, respectively.

A reference will be made to FIGS. 14A and 14B for describing how the sheets S are sequentially stacked on the stack tray 52. As shown in FIG. 14A, just after the start of printing, the first sheet or trial printing S1 driven out of the printer 1 to above the tray 52 is caused to fall due to its own weight. The opposite edges of the sheet S1 in the widthwise direction get on the ribs 204A–204D and 205A–205D and raised thereby. As a result, the edges of the sheet S1 contact the inner surfaces of the side fences 201 and 202. The operator positions the side fences 201 and 202 beforehand so as to set up the above condition. Specifically, the operator releases the pawls 224A and 225A of the arms 224 and 225 from the teeth 209A of the slide rail 209 and then slide the slider 216 on the slide rail 209, as stated earlier.

To facilitate the positioning of the side fences 201 and 202, a scale representative of various sheet sizes may be provided on the slide rail 209. This allows the operator to move the opposite sliders 216 while watching the scale.

During continuous printing following the trial printing, a sheet S2 has its leading edge positioned on abutting against the end plate 203. Then, the sheet S2 falls with its opposite widthwise edges being guided by the side fences 201 and 202. During the course of the fall, the arch-like deformation of the sheet S2 is reduced due to air resistance. The sheet S2 is stacked as represented by a sheet S3 in FIG. 14A. As shown, the sheet S3 is short of the distance between the inner surfaces of the side fences 201 and 202.

As the following sheets S are sequentially stacked on the sheet S3, the sheet S3 sequentially extends in the widthwise direction due to the increasing weight until it abuts against the inner surfaces of the side fences 201 and 202. At this instant, the sheet S3 is buckled, as represented by a sheet S4, due to the reaction of the side fences 201 and 202 ascribable to the extension. When the sheet S4 reaches the stacking surface of the base 52', its opposite edges in the widthwise direction get on the ribs 204A–204D and 205A–205D and are raised thereby to contact the inner surfaces of the side fences 201 and 202. As a result, the sheet S4 is provided with the inverted arch configuration, as represented by the sheet S1. If the ink on the sheet S1 has not been fully dried, the sheet S1 tends to regain the original or arch configuration. However, the sheet S1 is held in the inverted arch configuration because its opposite edges abut against the side fences 201 and 202. Moreover, the inverted arch configuration is promoted by the reaction of the side fences 201 and 202 against which the opposite edges of the sheet S1 have abutted. Consequently, all the sheets stacked on the base 52' are aligned with respect to the center of the inverted arch in the widthwise direction.

Figure 14B:
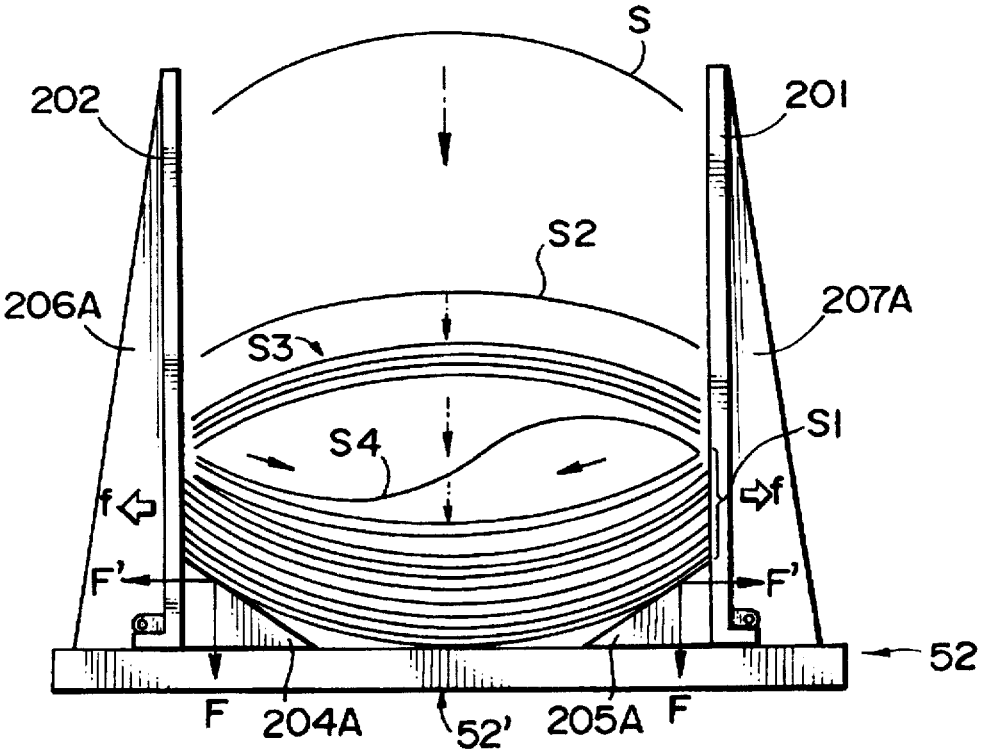

As shown in FIG. 14B, when the number of sheets driven out of the printer 1 increases, lowermost one of the sheets originally deformed in the arch configuration is buckled in the inverted arch configuration due to its own weight and the weight of the overlying sheets. As a result, the above sheet is laid on the underlying sheet whose opposite edges have already been reshaped by the ribs 204A–204D and 205A–205D, following the configuration of the underlying sheet. When the sheet with the inverted arch deformation is laid on the underlying sheet and slips down thereon, it is moved toward the center of the inverted arch. Hence, all the sheets stacked on the base 52' are aligned with respect to the center of the inverted arch in the widthwise direction.

As also shown in FIG. 14B, when the number of sheets stacked on the base 52' increases, the total weight F of the sheets acts on the inclined surfaces or the inclined ridge lines defined by the ribs 204A–204D and 205A–205D. This generates components F' and additionally generates forces $f$ with which the opposite edges of the sheets urge the side fences 201 and 202 away from each other. These components F' and forces $f$ are likely to cause the upper portions of the side fences 201 and 202 to turn about the lower ends. However, the outer ribs 206A–206D and 207A–207D prevent the side fences 202 and 201 from falling down outward.

Hence, the opposite edges of the sheets S are accurately positioned on the base 52'. This is also true when the sheet size in the widthwise direction is changed, because the sliders 216 are movable integrally with the side fences 201 and 202.

The inclined surfaces or the inclined ridges or the extensions thereof defined by the ribs 204A–204D and 205A–205D each has an upper end located at a constant level throughout the side fence 202 or 201 and extending parallel to the stacking surface of the base 52'. This prevents the widthwise center of the each sheet S provided with the inverted arch configuration from being dislocated in the lengthwise direction of the sheet S. Hence, even when the total weight of the sheets S increases, the side fences 201 and 202 are free from great opening forces while the sheets S are free from deformation in the lengthwise direction parallel to the direction of sheet discharge. Consequently, the opposite edges of the sheets S can be accurately aligned with each other.

For the stable stacking of the sheets S, it is preferable that the inner ribs 204A–204D and 205A–205D and outer ribs 206A–206D and 207A–207D be as great in number as possible and arranged over a long range. The ribs 204A–204D and 205A–205D and ribs 206A–206D and 207A–207D may be molded integrally with the associated side fences 201 and 202, if desired. Further, the ribs 204A–204D and 205A–205D and ribs 206A–206D and 207A–207D may be located at the same positions on the associated side fences 201 and 202 in the direction of sheet discharge. Then, the positions where the forces tending to move the side fences 201 and 202 outward are exerted by the sheets S and the positions where such forces are counteracted are coincident. This obviates moments tending to act between the above positions when they are deviated from each other, thereby preventing the side fences 201 and 202 from waving in the direction of sheet discharge.

After a desired number of sheets or printings S have been stacked on the base 52' in the inverted arch configuration, the stack is removed by hand. As shown in FIG. 8, wedge-like spaces are formed below the opposite widthwise edges of the bottom sheet S contacting the base 52'. These spaces are derived from the height of inclined surfaces or the inclined ridge lines defined the ribs 204A–204D and 205A–205D, and the distance L between the front ends of the side fences 201 and 202 and the end plate 203. The above spaces are exposed to the outside over the distance L. Hence, the operator can pick up the sheets S by inserting his fingers into the spaces through the clearances L, as indicated by an arrow A in FIG. 8, and then lifting the opposite edges of the sheets S. In this manner, the operator can take out the whole sheet stack at a time.

The height H of the inclined surfaces or that of the inclined ridge lines defined by the ribs 204A–204D and 205A–205D remain constant even when the size of the sheets S is changed. Hence, the spaces for inserting the operator's fingers are guaranteed without regard to the sheet size. The clearances L will decrease when the lengthwise dimension of the sheets S is small. Even in such a case, the above spaces are available only if the end plate 203 is moved to the position for forming the clearances L great enough to accommodate the operator's fingers. At this instant, because the front end of the sheet stack is accurately positioned by the end plate 203 until the desired number of sheets have been stacked, it is not disturbed even when the end plate 203 is moved to the above position. Further, even when the clearances L are small, the operator can insert his fingers into the wedge-like spaces in a direction indicated by an arrow B in FIG. 8.

As stated above, in the illustrative embodiment, each sheet S is provided with the inverted arch configuration in the widthwise direction not during the course of fall, but when it has fallen onto the stacking surface of the base 52'. Hence, although the following sheet may slip down on the upper surface of the preceding sheet, the former is accurately aligned with the latter With respect to the widthwise center. It follows that even when the image surface of the sheet S is not fully dry and tends to lengthen outward in the widthwise direction, the sheet S is laid on the underlying sheet S having been corrected in position by the ribs 204A–204D and 205A–205D of the side fences 202 and 201.

Figure 15:
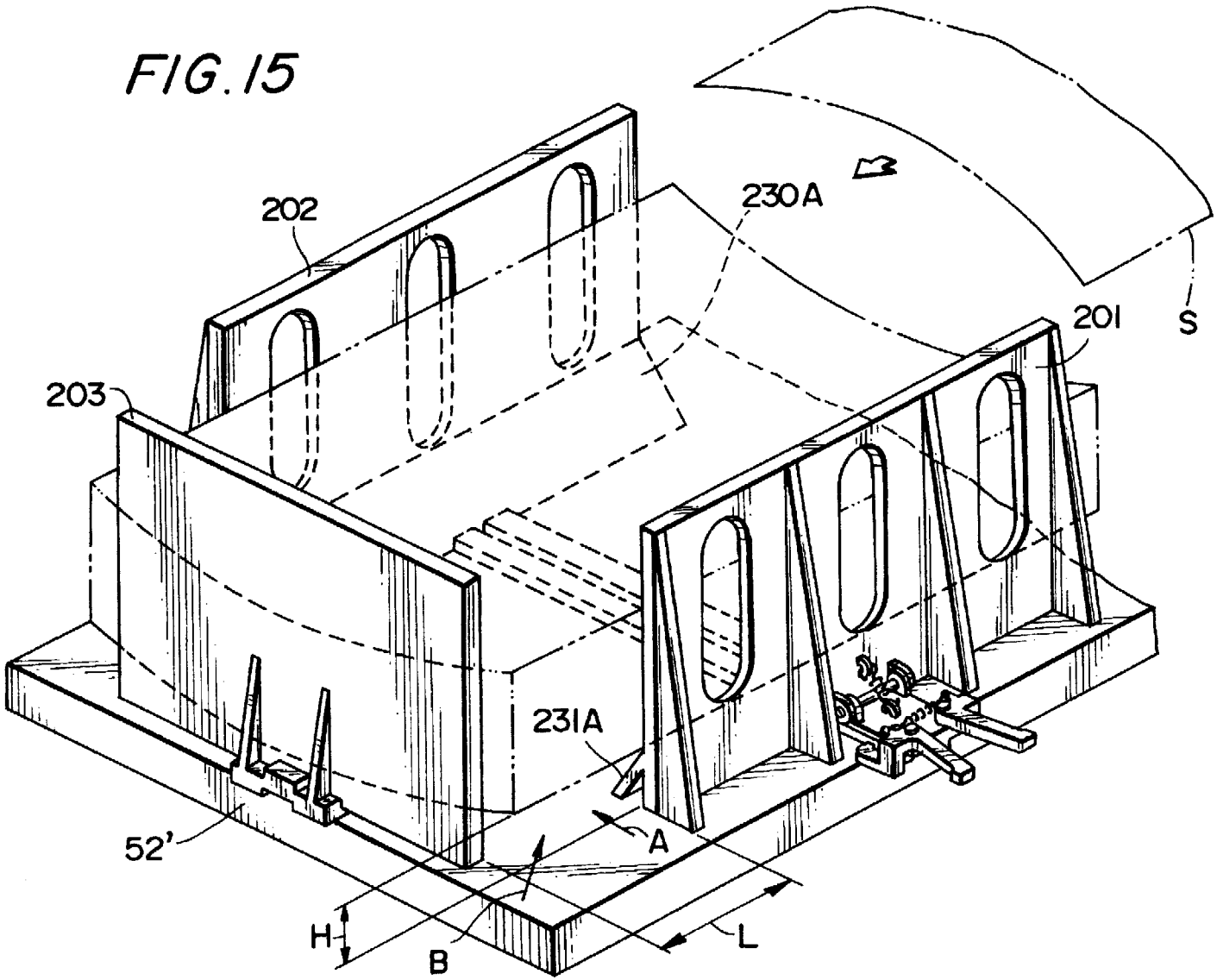
FIG. 15 is a perspective view showing another embodiment of the present invention.

FIG. 15 shows another embodiment of the present invention. As shown, this embodiment is similar to the previous embodiment except that the inner ribs 204A–204D and 205A–205D are replaced with inclined portions implemented by inclined surfaces 230A and 231A, respectively. The inclined surfaces 230A and 231A each extends in the direction of sheet discharge over the same dimension as the side fence 202 or 201. This kind of arrangement prevents, when the number of the sheets S stacked on the base 52', i.e., the total weight of the sheets S increases, the load acting on the bottom of the stack from being localized. As a result, the stack is prevented from being deformed by the ribs at its bottom and is maintained stable.

Figure 16:
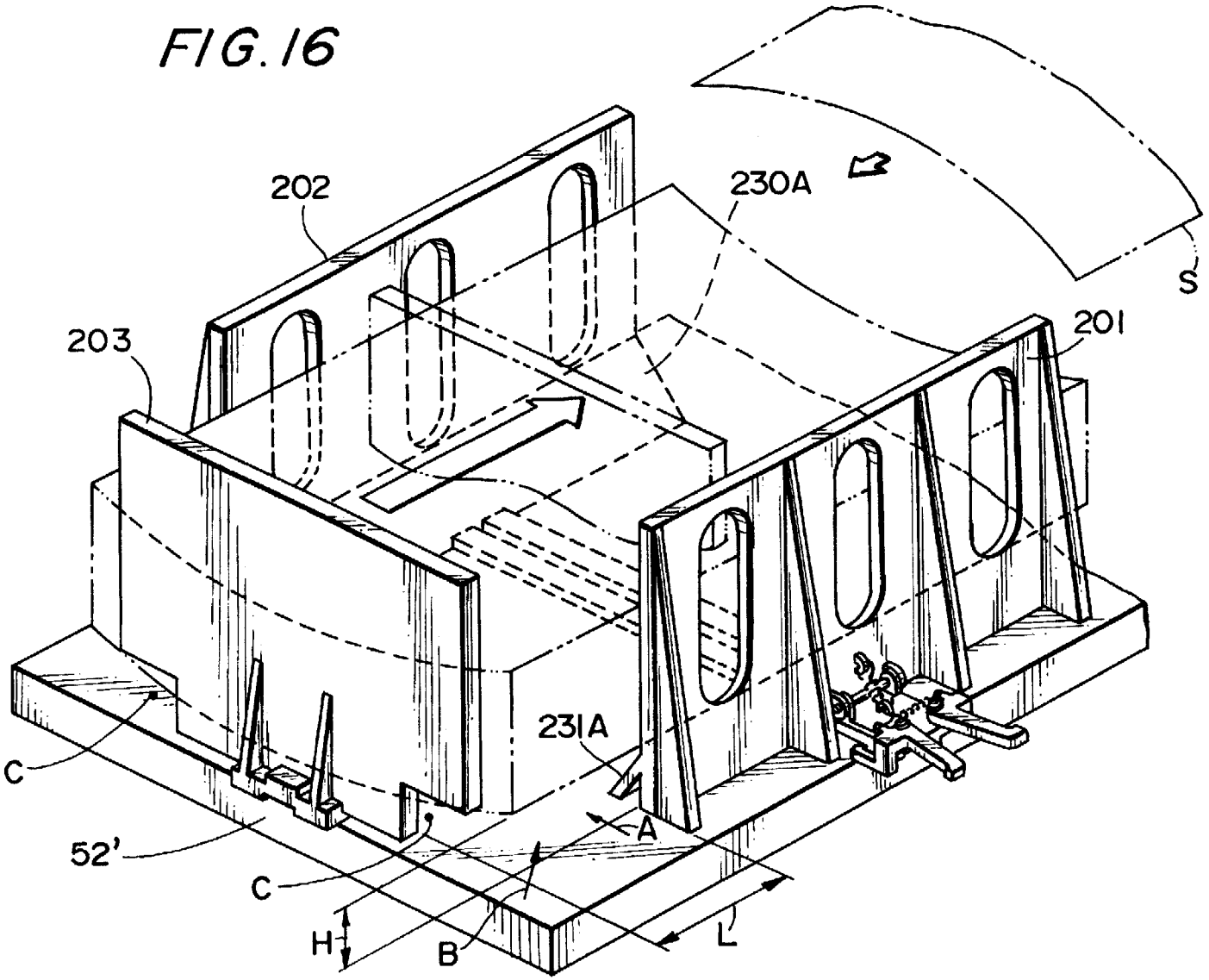
FIGS. 16 and 17 are perspective views showing other embodiments of the present invention.

FIG. 16 shows another embodiment of the present invention. The end plate 203 is movable in the direction of sheet discharge, as stated earlier. However, when the sheets S of, e.g., size A4 or B5 are stacked on the base 52' sideways, the end plate 203 should be moved toward the printer body over a substantial distance, as indicated by a dash-and-dots line in FIG. 16. In this case, the ribs 204A–204D and 205A–205D and inclined surfaces 230A and 231A must be prevented from interfering with the end plate 203. In this embodiment, the end plate 203 is formed with notches C at the opposite bottom corners in the widthwise direction of the sheet S. With this configuration, the end plate 203 can be moved even to the position shown in FIG. 16 without any interference.

Figure 17:
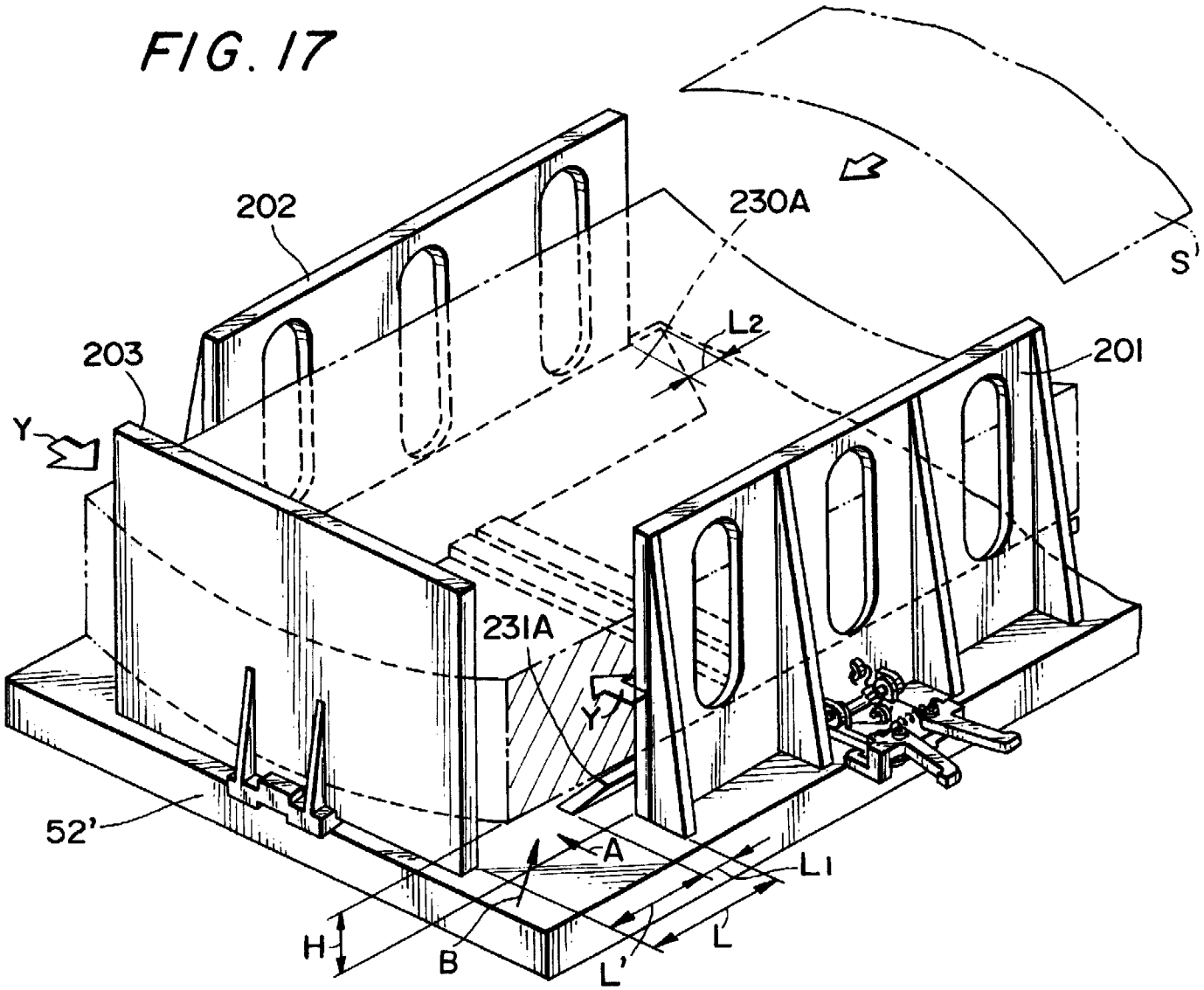

FIG. 17 shows still another embodiment of the present invention. As shown, the inclined surfaces 230A and 231A are each extended in the direction of sheet discharge. In the previous embodiments, the ribs 204A–204D and 205A–205D and inclined surfaces 230A and 231A are confined in the range of the side fences 201 and 202; for sheets of great size, the clearances L can be defined between the front ends of the side fences 201 and 202 and the end plate 203. Because nothing exists below the sheet stack over the above distance L, the operator's fingers can be inserted to below the sheet stack. However, as the number of sheets sequentially increases, the sheets stack is apt to bend downward and deform due to its own weight because it is not sustained over the distance L.

In FIG. 17, the inclined surfaces 230A and 231A extend beyond the range of the side fences 201 and 202. In this configuration, the clearance L' available for the operator's fingers is reduced, i.e., $L'=L-L_1$. However, if the distance L' of 20 mm to 30 mm is available, the operator can put his fingers below the opposite edges of the sheet stack, grip the edges in a direction indicated by an arrow Y and lift the stack almost as easily as in the previous embodiments. In addition, the sheet stack is prevented from hanging down and deforming. In the illustrative embodiment, the inclined surfaces 230A and 231A are extended not only toward the end plate 203 but also toward the printer body, as indicated by a distance $L_2$, in order to further reduce the deformation of the sheet stack.

Figure 18:
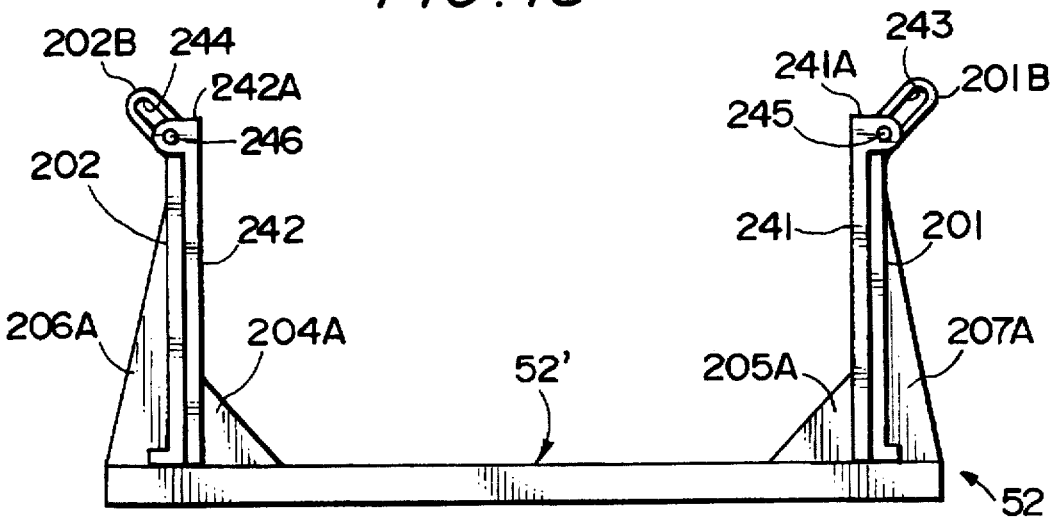
FIG. 18 shows a further embodiment of the present invention.
Figure 19:
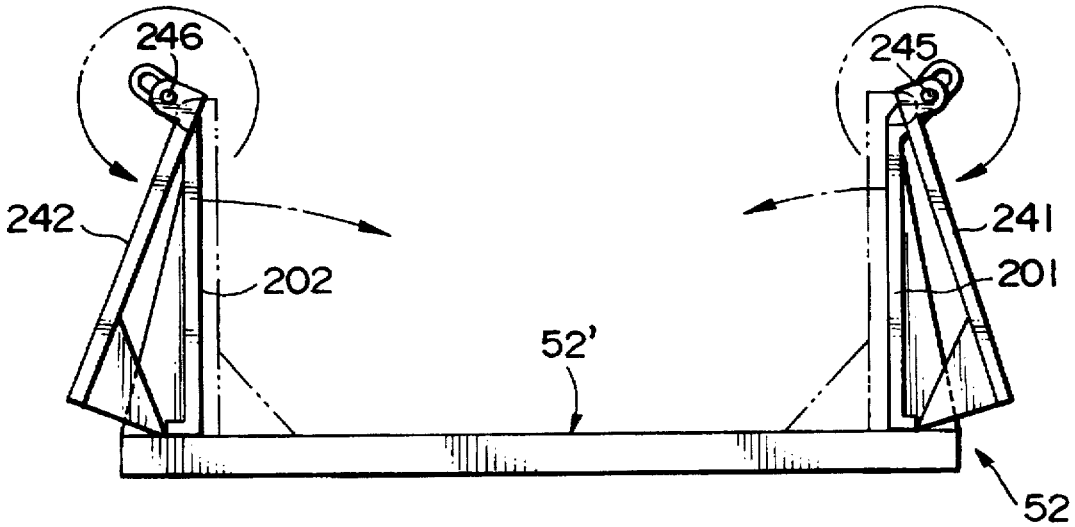
FIG. 19 is a view demonstrating the operation of the embodiment shown in FIG. 18.
Figure 20:
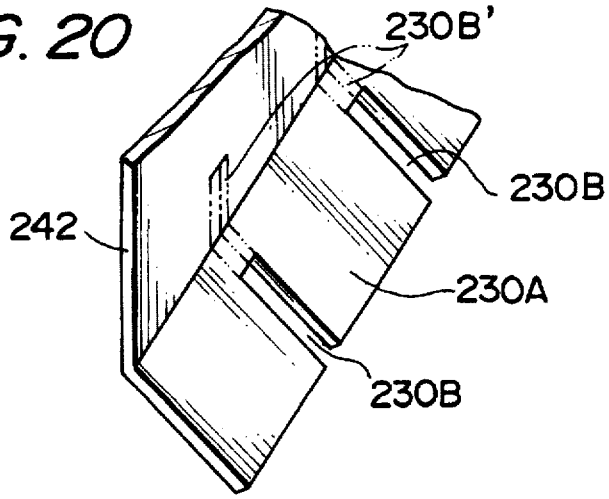
FIG. 20 is a fragmentary perspective view showing a modification of the embodiment shown in FIG. 18.

Referring to FIGS. 18–20, a further embodiment of the present invention will be described. In this embodiment, the stack tray 52 is provided with a foldable configuration. When the printer 1 is not operated for a long period of time, it is sometimes stored at a remote place. Then, a space available for a storage is questionable. In the illustrative embodiment, the tray 52 can be folded and stored integrally with a side wall of the printer 1. This successfully reduces the space to be occupied by the printer 1 during storage.

Specifically, as shown in FIG. 18, the tray 52 can be folded onto the side wall of the printer 1 via a hinge mechanism, not shown. The side fences 202 and 201 mounted on the base 52' are provided only with the outer ribs 206A–206D and 207A–207D shown in FIG. 8. The side fences 201 and 202 are each foldable onto the stacking surface of the base 52' via a respective hinge portion having a locking mechanism, not shown. When the locking mechanism associated with any of the side fences 201 and 202 is operated, the side fence 201 or 202 is held in its upright position or operative position on the base 52'. The locking mechanisms for the side fences 201 and 202 each includes a click stop spring whose point of action is variable between a position where the moment is greater when the side fence 201 or 202 is unfolded than when it is folded and a position where such a relation is reversed. Specifically, when each side fence 201 or 202 is unfolded or upright, the associated locking mechanism urges the fence 201 or 202 outward and thereby holds it in the upright position. When the side fence 201 or 202 is folded or laid flat, the locking mechanism urges it downward and thereby maintains it in the flat position.

The inner ribs 204A–204D and 205A–205D are provided on rib mount members 242 and 241, respectively. The rib mount members 241 and 242 are respectively independent of the side fences 201 and 202 and play the role of reshaping means. These members 241 and 242 are respectively supported by the side fences 201 and 202 in such a manner as to be rotatable outward away from the inner surfaces of the fences 201 and 202. The inner ribs 204A–204D and 205A–205D and outer ribs 206A–206B and 207A–207D are so positioned as not to interfere with each other.

More specifically, pins 245 and 246 are affixed to the upper ends of the rib mount members 241 and 242, respectively. The pins 245 and 246 are respectively received in holes 243 and 244 formed in the upper portions of the side fences 201 and 202. The holes 243 and 244 allow the pins 245 and 246 to define fulcrums about which the rib mount members 241 and 242 are rotatable. For this purpose, the holes 243 and 244 are each implemented as an elongate hole. As shown in FIG. 18, when the rib mount members 241 and 242 are respectively rotated about the pins 245 and 246 into contact with the inner surfaces of the side fences 201 and 202, the bottoms of the ribs 204A–204D and 205A–205D are caused to contact the stacking surface of the base 52'. As shown in FIG. 19, when the rib mount members 241 and 242 are respectively rotated outward away from the inner surfaces of the side fences 201 and 202, the bottoms of the ribs 204A–204D and 205A–205D are caused to abut against the stacking surface of the base 52' at their ends without biting into the stacking surface.

When the printer 1 is not stored, the side fences 201 and 202 and rib mount members 241 and 242 are held in their positions shown in FIG. 18. Specifically, the side fences 201 and 202 are held upright while the rib mount members 241 and 242 are held in contact with the inner surfaces of the side fences 201 and 202, respectively.

When the sheets S are sequentially stacked on the base 52', the outer ribs 206A–206D and 207A–207D respectively prevent the side fences 202 an 201 from falling down outward in the widthwise direction of the sheet S when subjected to the forces F', FIG. 14B. On the other hand, the inner ribs 204A–204D and 205A–205D respectively protrude from the rib mount members 242 and 241 into the stacking surface of the base 52', thereby reshaping the sheets S sequentially falling toward the base 52'.

As shown in FIG. 19, when the printer 1 is to be stored, the rib mount members 241 and 242 are rotated outward away from the inner surfaces of the side fences 201 and 202, respectively. By shifting the pins 245 and 246 of the members 241 and 242 in the associated holes 243 and 244, it is possible to locate the ends of the bottoms of the ribs 204A–204D and 205A–205D on the stacking surface of the base 52'. After the ribs 204A–204D and 205A–205D on the rib mount members 241 and 242 have been respectively brought to between the ribs 206A–206D and 207A–207D, the side fences 202 and 201 are folded onto the stacking surface of the base 52'. Subsequently, the base 52' is folded onto the side wall of the printer 1.

While the above embodiment is applied to the ribs 204A–204D and 205A–205D, it is similarly applicable to the inclined surfaces 230A and 231A, FIG. 15. In this case, the inclined surfaces 230A and 231A are provided independently of the side fences 201 and 202. As shown in FIG. 20, the inclined surface 230A (or 231A) is formed with slits 230B (or 231B although not shown). The slits 230B (or 231B) prevent the inclined surface 230A (or 231A) from interfering with the outer ribs 206A–206D (or 207A–207D). Although such inclined surfaces 230A and 231A are not continuous in the direction of sheet discharge, they are as effective as when they are continuous because the slits 230B and 231B are extremely narrow, compared to the overall length of the inclined surfaces 230A and 231A.

The gist with the illustrative embodiment is that during the course of sheet discharge the side fences be prevented from moving outward in the widthwise direction of the sheet S when subjected to the forces F', FIG. 14B, and that at the time of storage the ribs 204A–204D and 205A–205D or the surfaces 230A and 231A be movable away from the side fences 201 and 202.

In summary, it will be seen that the present invention provides a sheet discharging device for a printer and having various unprecedented advantages, as enumerated below.

(1) A stack tray has a base on which a pair of side fences each having an inclined portion are mounted. The side fences are moved to positions matching the width of sheets beforehand. When a sheet driven out of a printer falls onto the base, the opposite widthwise edges of the sheet are reshaped in an inverted arch configuration by the inclined portions of the side fences. Hence, sheets sequentially stacked on the base have their edges accurately aligned with each other.

(2) The side fences facing the opposite edges of the sheets do not move away from each other despite pressures exerted thereon by the edges. Hence, even when great number of sheets are stacked on the base, the side fences are capable of surely aligning the edges of the sheets.

(3) Because the side fences align the opposite edges of the sheets at their positions matching the sheet size, the side fences are capable of aligning the edges without regard to the sheet size.

(4) The sheet reached the base has its opposite ends surely reshaped in the inverted arch configuration, as stated above. In addition, the edges of the sheet continuously contact the reshaping portions. Hence, the sheet is free from waving ascribable to concentrated loads, caving or similar deformation, and damage.

(5) Clearances for accommodating the operator's fingers are available between the front ends of the side fences and an end plate. The clearances allow the operator to take out the stack of sheets with ease.

(6) Reshaping means are rotatable independently of the side fences, and the side fences are also rotatable. This allows the members for aligning the opposite edges of the sheets to be folded outward away from the sheet guide surfaces. It follows that the base with the side fences can be folded in a compact configuration.

(7) The end plate is notched at its opposite bottom corners so as not to interfere with members which form the inclined portions. Therefore, when the sheets are stacked on the base sideways or when their size is small, the end place can be moved even to a position where it intervenes between the side fences. This allows the side fences to be located at optimal positions in the event of printing.

Various modifications will become possible for those skilled in the art after receiving the teachings of the present disclosure without departing from the scope thereof.

What is claimed is:

1. A sheet stacking device having a base for stacking sheets driven out of an image forming apparatus, said device comprising:

a pair of side fences mounted on said base and facing each other, and each being movable in a widthwise direction of the sheets perpendicular to an intended direction of sheet discharge, and comprising a guide surface parallel to the intended direction of a sheet discharge at a position thereof facing one of opposite edges of the sheet in the widthwise direction; and an end plate mounted on a front portion of said base in the intended direction of the sheet discharge, and having a surface for stopping a leading edge of the sheet in the intended direction of sheet discharge;

said pair of side fences each further comprising an inclined portion in a lower portion of said guide surface facing the one edge of the sheet, said inclined portion protruding toward a center in the widthwise direction of the sheets from an upper portion to a lower portion of said side fence, and having an angle for causing the edge of the sheet to warp upward, wherein the sheets fall due to their own weight while changing shape into a convex shape and are aligned in a concave shape in the widthwise direction of the sheets due to the relation between the sheets and the side fences.

2. A device as claimed in claim 1, wherein said inclined portion has an inclined surface or an inclined ridge line.

3. A device as claimed in claim 2, wherein an extension of said inclined surface or an extension of said inclined ridge line intersect said guide surface at a point or a line substantially parallel to a stacking surface of said base.

4. A device as claimed in claim 2, wherein said inclined portion comprises a plurality of inclined portions, and wherein at least part of said plurality of inclined portions positioned on said guide surface of said side fence are spaced in the intended direction of sheet discharge.

5. A device as claimed in claim 2, wherein said inclined portion comprises a continuous inclined surface extending in the intended direction of sheet discharge.

6. A device as claimed in claim 5, wherein said continuous inclined surface is confined in a range of said side fence in the intended direction of sheet discharge.

7. A device as claimed in claim 5, wherein said continuous inclined surface is extended beyond a range of said side fence in the intended direction of sheet discharge.

8. A device as claimed in claim 1, further comprising a stop provided on a surface of each of said pair of side fences opposite to said guide surface, and for preventing said side fence from failing down, wherein said stop has a bottom which is supported by a stacking surface of said base.

9. A device as claimed in claim 1, wherein said pair of side fences each comprises a slider movable in a direction perpendicular to the intended direction of sheet discharge and capable of being locked in said direction.

10. A device as claimed in claim 1, wherein said pair of side fences each has a front end thereof in the direction of sheet discharge located at a position where a clearance extending in the intended direction of sheet discharge is capable of being formed between said side fence and said end plate.

11. A device as claimed in claim 1, wherein said end plate is notched at opposite bottom corners thereof so as not to interfere with members each forming said inclined portion when said end plate is moved.

12. A sheet stacking device having a base for stacking sheets driven out of an image forming apparatus, said device comprising:

a pair of side fences mounted on said base and facing each other, and each being movable in a widthwise direction of the sheets perpendicular to an intended direction of sheet discharge, and foldable toward and away from a stacking surface of said base, and comprising a guide surface parallel to the intended direction of sheet discharge at a position thereof facing one of opposite edges of the sheet in the widthwise direction;

an end plate mounted on a front portion of said base in the intended direction of sheet discharge, and having a surface for stopping a leading edge of the sheet in the intended direction of sheet discharge; and a pair of reshaping means respectively independent of said pair of side fences, and each comprising an inclined surface or an inclined ridge line in a lower portion of a guide surface thereof which faces the edge of the sheet, said inclined surface or said inclined ridge line protruding toward a center in the widthwise direction of the sheets from an upper portion to a lower portion of said reshaping means, and having an angle for causing the edge of the sheet to warp upward, said inclined surface or said inclined ridge line being retractable outward away from said guide surface of said side fence.

13. A device as claimed in claim 12, wherein said pair of reshaping means are each rotatable, and wherein when said side fences associated with said reshaping means are tilted toward said stacking surface of said base, said reshaping means each has a rotating position thereof toward said stacking surface set about a center of rotation included in said side fence.

14. A sheet stacking device having a base for stacking sheets driven out of an image forming apparatus, said device comprising:

a pair of side fences mounted on said base and facing each other, and each being movable in a widthwise direction of the sheets perpendicular to an intended direction of sheet discharge, and comprising a guide surface parallel to the intended direction of sheet discharge at a position thereof facing one of opposite edges of the sheet in the widthwise direction; and an end plate mounted on a front portion of said base in the intended direction of sheet discharge, and having a surface for stopping a leading edge of the sheet in the intended direction of sheet discharge;

said pair of side fences each further comprising an inclined portion in a lower portion of said guide surface facing the one edge of the sheet, said inclined portion protruding toward a center in the widthwise direction of the sheets from an upper portion to a lower portion of said side fence, and having an angle for causing the edge of the sheet to warp upward, said inclined portion having a continuous inclined surface being extended beyond a range of said side fence in the intended direction of sheet discharge.

* * * * *